US007002537B1

(12) United States Patent
Ito

(10) Patent No.: US 7,002,537 B1
(45) Date of Patent: Feb. 21, 2006

(54) METHOD OF DRIVING ELECTROOPTIC DEVICE, DRIVING CIRCUIT, ELECTROOPTIC DEVICE, AND ELECTRONIC APPARATUS

(75) Inventor: Akihiko Ito, Tatsuno-cho (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 09/856,853

(22) PCT Filed: Sep. 26, 2000

(86) PCT No.: PCT/JP00/06621

§ 371 (c)(1),
(2), (4) Date: May 25, 2001

(87) PCT Pub. No.: WO01/24155

PCT Pub. Date: Apr. 5, 2001

(30) Foreign Application Priority Data

Sep. 27, 1999 (JP) ..... 11-273115
Sep. 29, 1999 (JP) ..... 11-277540

(51) Int. Cl.
*G09G /336* (2006.01)

(52) U.S. Cl. ..... 345/87; 89/94; 89/99; 315/169.3

(58) Field of Classification Search ..... 345/87, 345/88, 89, 90, 94, 100, 99, 96, 66, 60, 691, 345/690; 349/144, 145; 315/169.3, 169.2, 315/169.4; 313/585
See application file for complete search history.

(56) References Cited

U.S. PATENT DOCUMENTS 5,633,659 A * 5/1997 Furuhashi et al. ..... 345/173
5,818,557 A * 10/1998 Konuma et al. ..... 349/93
5,852,429 A * 12/1998 Scheffer et al. ..... 345/100
5,892,495 A * 4/1999 Sakai et al. ..... 345/98
6,061,103 A * 5/2000 Okamura et al. ..... 348/767
6,094,184 A * 7/2000 Okamoto ..... 345/89
6,232,938 B1 * 5/2001 Tsuchida et al. ..... 345/88
6,384,887 B1 * 5/2002 Yasuda et al. ..... 349/129
6,392,624 B1 * 5/2002 Yang et al. ..... 345/94
6,414,664 B1 * 7/2002 Conover et al. ..... 345/89
6,429,836 B1 * 8/2002 Hansen ..... 345/74.1
6,433,763 B1 * 8/2002 Lim et al. ..... 345/68
6,462,724 B1 * 10/2002 Ozawa et al. ..... 345/87
6,476,875 B1 * 11/2002 Correa et al. ..... 348/607

FOREIGN PATENT DOCUMENTS

JP 61-5295 A 1/1986
JP 63-107381 A 5/1988

(Continued)

*Primary Examiner*—Xiao Wu
*Assistant Examiner*—Abbas Abdulselam
(74) *Attorney, Agent, or Firm*—Oliff & Berridge, PLC

(57) ABSTRACT

To provide a highly versatile device which can produce a gray-scale display by applying two-level signals to data lines. When producing an 8-level gray-scale display, a single frame (1*f*) is divided into a first time period T1 to apply two-level signals to a liquid crystal layer in accordance with gray-scale data and a second time period T2 to apply an H-level voltage to the liquid crystal layer in accordance with a threshold voltage of liquid crystal. The first time period T1 is further divided into 7 sub-fields (Sf1 to Sf7) in accordance with gray-scale characteristics of an electro-optical device. Either an H or L level is written in accordance with a gray level of each pixel every sub-field. Thus, the ratio of an on period or an off period of the pixel to the single time frame is controlled.

21 Claims, 21 Drawing Sheets

(a)

FOREIGN PATENT DOCUMENTS

| | | |
|---|---|---|
| JP | 01-284894 | 11/1989 |
| JP | 06-095075 | 4/1994 |
| JP | 07-199152 | 8/1995 |
| JP | 9-319342 A | 12/1997 |
| JP | 07-49482 | 2/1998 |
| JP | 11-038928 | 2/1999 |
| JP | 11-143429 | 5/1999 |
| WO | WO 00/70594 | 11/2000 |

* cited by examiner

Fig. 7

(a) WHEN FR = L

| GRAY-SCALE DATA D0~D2 | Ds | | | | | | |
|---|---|---|---|---|---|---|---|
| | Sf1 | Sf2 | Sf3 | Sf4 | Sf5 | Sf6 | Sf7 |
| (000) | L | L | L | L | L | L | L |
| (001) | H | L | L | L | L | L | L |
| (010) | H | H | L | L | L | L | L |
| (011) | H | H | H | L | L | L | L |
| (100) | H | H | H | H | L | L | L |
| (101) | H | H | H | H | H | L | L |
| (110) | H | H | H | H | H | H | L |
| (111) | H | H | H | H | H | H | H |

| | Ds |
|---|---|
| Von PERIOD | H |
| Voff PERIOD | L |

(b) WHEN FR = H

| GRAY-SCALE DATA D0~D2 | Ds | | | | | | |
|---|---|---|---|---|---|---|---|
| | Sf1 | Sf2 | Sf3 | Sf4 | Sf5 | Sf6 | Sf7 |
| (000) | H | H | H | H | H | H | H |
| (001) | L | H | H | H | H | H | H |
| (010) | L | L | H | H | H | H | H |
| (011) | L | L | L | H | H | H | H |
| (100) | L | L | L | L | H | H | H |
| (101) | L | L | L | L | L | H | H |
| (110) | L | L | L | L | L | L | H |
| (111) | L | L | L | L | L | L | L |

| | Ds |
|---|---|
| Von PERIOD | L |
| Voff PERIOD | H |

METHOD OF DRIVING ELECTROOPTIC DEVICE, DRIVING CIRCUIT, ELECTROOPTIC DEVICE, AND ELECTRONIC APPARATUS

BACKGROUND OF THE INVENTION

1. Field of Invention

The present invention relates to driving methods and driving circuits for electro-optical devices which perform gray-scale display control using pulse-width modulation, electro-optical devices, and electronic apparatuses.

2. Description of Related Art

Electro-optical devices, such as liquid crystal displays using liquid crystal as electro-optical material, are widely used as display devices in place of cathode-ray tubes (CRTs) in display devices of various information processing apparatuses and in liquid crystal televisions.

By way of example, a conventional electro-optical device has the following structure. Specifically, the conventional electro-optical device includes an element substrate on which pixel electrodes aligned in the form of a matrix and switching devices such as TFTs (Thin Film Transistors) connected to the pixel electrodes are provided, an opposing substrate on which counter electrodes opposed to the pixel electrodes are formed, and liquid crystal, i.e., electro-optical material, filled between the two substrates. With this arrangement, when a scanning signal is supplied to the switching devices via scanning lines, the switching devices become active. In this active state, when an image signal with a voltage in accordance with a gray-scale level is supplied to the pixel electrodes through data lines, a charge in accordance with the voltage of the image signal is accumulated in the liquid crystal layer between the pixel electrodes and the counter electrodes. When the switching devices enter an off state after the charge has been accumulated, the accumulated charge in the liquid crystal layer is maintained by the capacitance of the liquid crystal layer and by storage capacitors. Accordingly, when the switching devices are driven to control the amount of charge accumulated in accordance with the gray-scale level, alignment of the liquid crystal varies according to each pixel, that is, the gray-scale level varies according to each pixel. As a result, gray-scale display can be performed.

It is only necessary to accumulate charge in the liquid crystal layer of each pixel for a partial time period. First, a scanning-line driving circuit sequentially selects each scanning line. Second, a data-line driving circuit sequentially selects each data line within the scanning-line selection time period. Third, an image signal with a voltage in accordance with a gray scale is sampled on the selected data line. As a result, time-division multiplexing driving in which the scanning line and the data line are shared by a plurality of pixels is made possible.

SUMMARY OF THE INVENTION

An analog image signal in accordance with the gray scale is supplied to the data line. It is necessary to provide a D/A converter circuit and an operational amplifier in a peripheral circuit of the electro-optical device. This increases cost of the overall device. However, display unevenness is caused by nonuniformity in characteristics of the D/A converter circuit and the operational amplifier and by nonuniformity in various wiring resistances. It is therefore difficult to create a high-quality display. In particular, this problem becomes noticeable with high-definition display.

Concerning electro-optical material such as liquid crystal, the relationship between the applied voltage and transmissivity differs according to the type of electro-optical material. Therefore with a driving circuit for driving electro-optical devices, a general-purpose driving circuit for driving various types of electro-optical devices is desirable.

In view of the above design problems, it is an object of the present invention to provide an electro-optical device that produces a high-quality and high-definition gray-scale display, a driving method and a driving circuit therefor, and an electronic apparatus using the electro-optical device.

In order to achieve the above objects, a first invention is a driving method for an electro-optical device which creates a gray-scale display of a plurality of pixels arranged in the form of a matrix. The driving method is characterized by a first time period which is part of a single time frame that is in turn divided into a plurality of sub-fields, and in each sub-field, turning on or off of each pixel is controlled in accordance with a gray level of the pixel. In a second time period which is the remaining period of the single time frame, the pixels are turned on or off in accordance with a threshold voltage of a transmissivity characteristic relative to a voltage applied to electro-optical material used in the electro-optical device.

According to the first invention, in the first time period of the single time frame, the period for turning on (or off) of a pixel is pulse-width modulated in accordance with the gray-scale of the pixel. As a result, gray-scale display using effective-value control is performed. In each sub-field, it is only necessary to designate turning on or off of the pixel.

In the first embodiment of the invention, the signals applied to the pixels are digital signals. Thus, any display unevenness due to nonuniformity in device characteristics and wiring resistances is prevented. As a result, a high-quality and high-definition gray-scale display can be produced. Also, in the second time period, turning on/off of the pixel is controlled in accordance with the threshold voltage of the electro-optical material. Even with differences in the composition of cell gap, or temperature characteristic of the liquid crystal, it is possible to apply an appropriate voltage to the electro-optical material for the second time period. As a result, the difference in the material characteristics can be absorbed in the second time period. The second period is not necessarily continuous and can be dispersed within the single time frame.

In this first embodiment of the invention, the single frame is used as a time period required to form a single rastered picture by performing, horizontal scanning and vertical scanning in synchronization with a horizontal scanning signal and a vertical scanning signal.

According to an aspect of the first embodiment of the invention, the pixels are provided corresponding to respective intersections of a plurality of scanning lines and a plurality of data lines. When scanning signals are supplied to the respective scanning lines, the pixels are turned on/off in accordance with voltages applied to the data lines. In the first time period, the scanning signals are sequentially supplied to the respective scanning lines of every sub-field. Each signals designating turning on or off of each pixel in accordance with a gray scale of the pixel, are supplied to the respective data lines which correspond to the respective pixels. In the second time period, the scanning signals are sequentially supplied to the respective scanning lines. A signal designating turning on or off of the pixels, in accordance with the threshold value of the transmissivity characteristic relative to the voltage applied to the electro-optical material, is supplied to the data lines. In this aspect, the above operation is performed for all the pixels.

Preferably, the second time period includes an on period for turning on all the pixels and an off-period for turning off all the pixels, and the length of the on-period is determined in accordance with the threshold value of the transmissivity characteristic relative to the voltage applied to the electro-optical material. In addition, a temperature may be detected, and the length of the on-period in the second time period may be determined in accordance with the detected temperature. In this case, even when the threshold value of the transmissivity characteristic changes in accordance with a change in the ambient temperature, it is possible to appropriately change the on-period. Concerning the detection of temperature, the temperature of the electro-optical device can be directly detected, or indirectly by measuring the ambient temperature around the electro-optical device. In other words, the detection of temperature measures a temperature change which influences the characteristics of the electro-optical material.

In order to achieve the above objects, a second embodiment of the invention is a driving circuit for an electro-optical device, which drives pixels including pixel electrodes, provided corresponding to respective intersections of a plurality of scanning lines, and a plurality of data lines and switching devices for establishing conduction between the data lines and the pixel electrodes when scanning signals are supplied to the scanning lines. The driving circuit includes a scanning-line driving circuit for sequentially supplying, in a first time period forming part of a single time frame, the scanning signals to the respective scanning lines every sub-field which is obtained by dividing the first time period. In a second time period of the single time frame, excluding the first time period, the scanning-line driving circuit sequentially supplies the scanning signals, which make the switching devices active, to the respective scanning lines. A data-line driving circuit supplies, in the first time period, signals each designating turning on or off of each pixel, in accordance with a gray level of the pixel every sub-field to the data lines which correspond to the pixels within a period for supplying the scanning signals to the scanning lines corresponding to the pixels. In the second time period, the data-line driving circuit supplies a signal which activates turning on or off of the pixels in accordance with a threshold value of a transmissivity characteristic, relative to a voltage applied to electro-optical material used in the electro-optical device to the data lines which correspond to the pixels.

According to the second embodiment of the invention, for reasons similar to those described in the first embodiment, the signals supplied to the pixels are digital signals. Thus, display unevenness due to nonuniformity in device characteristics and wiring resistances is prevented. As a result, a high-quality and high-definition gray-scale display can be produced. Also, in the second time period, turning on/off of the pixel is controlled in accordance with the threshold voltage of the electro-optical material. Even with differences in the composition, cell gap, or temperature characteristic of the liquid crystal, it is possible to apply an appropriate voltage to the electro-optical material for the second time period. As a result, the versatility of the driving circuit is increased.

In order to achieve the above objects, a third embodiment of the invention is characterized by including an element substrate with pixel electrodes provided corresponding to respective intersections of a plurality of scanning lines and a plurality of data lines and switching devices, which are provided for the respective pixel electrodes to control conduction between the data lines and the pixel electrodes based on scanning signals supplied through the scanning lines. An opposing substrate includes a counter electrode which is opposite to the pixel electrodes. Electro-optical material is held between the element substrate and the opposing substrate. A scanning-line driving circuit sequentially supplies, in a first time period forming part of a single time frame, the scanning signals to the respective scanning lines every sub-field which is obtained by dividing the first time period. In a second time period of the single frame, excluding the first time period, the scanning-line driving circuit sequentially supplies the scanning signals, which make the switching devices conducting, to the respective scanning lines. A data-line driving circuit supplies, in the first time period, two-level signals each designating turning on or off each pixel in accordance with a gray-scale, of the pixel every sub-field to the data lines corresponding to the pixels in a time period for supplying the scanning signals to the scanning lines corresponding to the pixels. In the second time period, the data-line driving circuit supplies a signal which designates turning on or off the pixels in accordance with a threshold value of a transmissivity characteristic relative to a voltage applied to the electro-optical material used in the electro-optical device to the data lines which correspond to the pixels.

According to the third embodiment of the invention, for reasons similar to those described in the first and second embodiments, the signals applied to the pixels are digital signals. Thus, display unevenness due to nonuniformity in device characteristics and wiring resistances is prevented. As a result, a high-quality and high-definition gray-scale display can be produced.

According to the third embodiment of the invention, it is preferable that a two-level signal be applied to the counter electrode, and that the polarity of each signal that designates turning on or off the pixel be inverted in accordance with the level of the two-level signal. Concerning cases in which more than one voltage level are applied to the counter electrode, the average value is used as a reference. The voltages applied to the pixel have opposite polarities, and the absolute values of the voltages are equal. Thus, application of a direct current component to the liquid crystal material held between the pixel electrodes and the counter electrode is prevented.

According to the third embodiment of the invention, a potential of the counter electrode may be fixed at a predetermined reference potential, and the polarity of each signal which designates turning on or off the pixel may be inverted with a predetermined period. In addition, the signal which designates turning on or off the pixel may be a three-level signal in which the polarity is inverted with the reference potential at the center. With this arrangement, when the reference potential is regarded as the center, the voltages applied to the pixel have opposite polarities, and the absolute values of the voltages are equal. Thus, application of a DC current to the electro-optical material held between the pixel electrodes and the counter electrode is prevented.

According to an aspect of the third invention, it is preferable that the element substrate be formed of a semiconductor substrate. Preferably, the scanning-line driving circuit and the data-line driving circuit are formed on the element substrate, and the pixel electrodes are reflective. Since the electron-transfer rate of the semiconductor substrate is high, it is possible to increase the responsiveness and reduce the size of the switching devices formed on the substrate and the component devices of the driving circuit.

Since the semiconductor substrate is opaque, the electro-optical device is used as a reflection-type device.

In order to achieve the above objects, an electronic apparatus according to a fourth embodiment of the invention includes the above-described electro-optical device. Thus, a D/A converter circuit and an operational amplifier become unnecessary, and the electronic apparatus is not affected by nonuniformity in characteristics of the D/A converter circuit and the operational amplifier and by nonuniformity in various wiring resistances. According to the electronic apparatus, the cost is reduced, and high-quality and a high-definition gray-scale display can be performed.

BRIEF DESCRIPTION OF THE DRAWINGS

FIGS. 7(*a*) and (*b*) are tables showing the converted contents of gray-scale data in the data-line driving circuit in the electro-optical apparatus and the contents of two-level signals in the Von period and the Voff period.

DETAILED DESCRIPTION OF EXEMPLARY EMBODIMENTS

Embodiments of the present invention are described with reference to the drawings.

<Conceptual Assumption>

Figure 1:
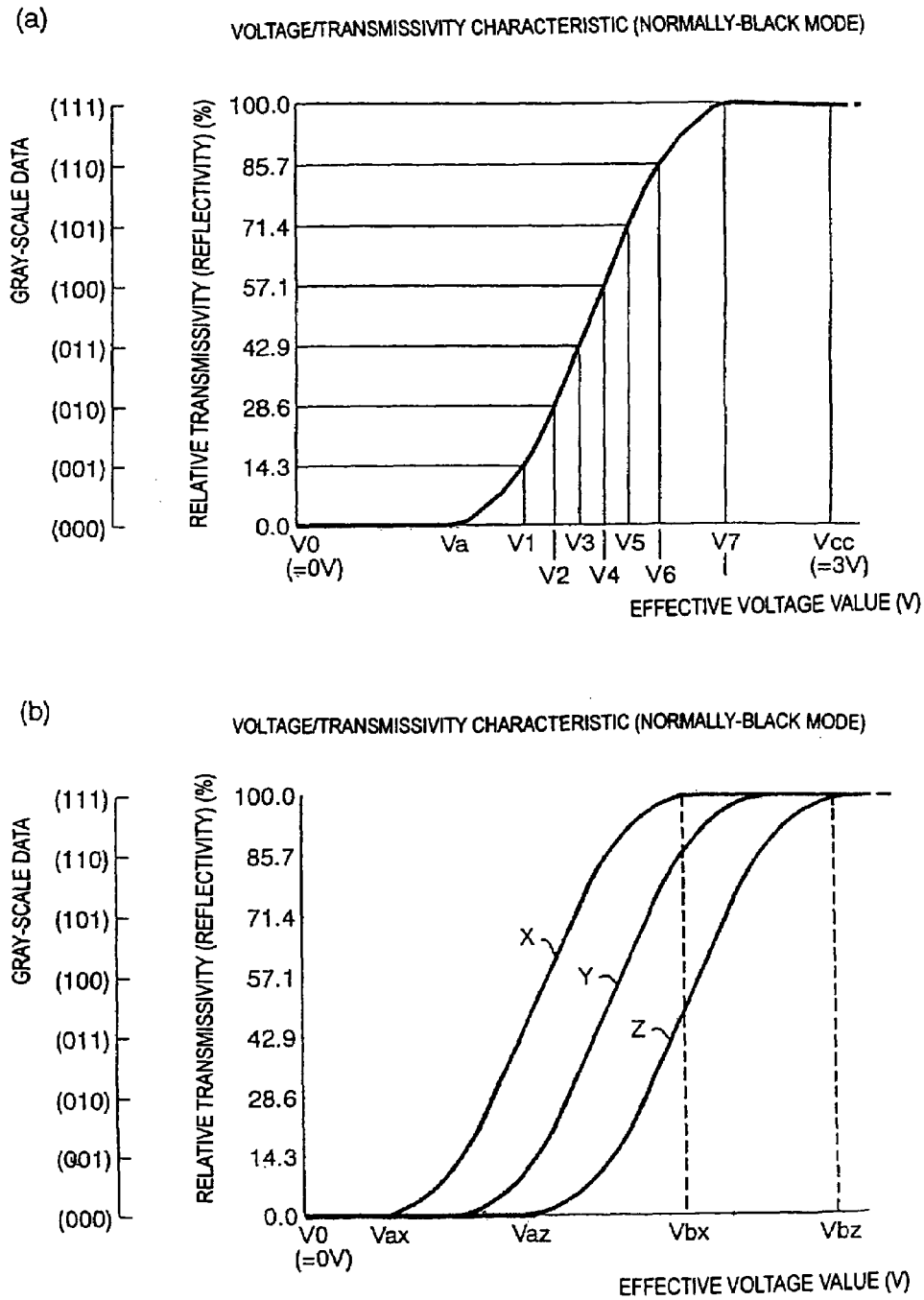
FIG. 1(*a*) is an illustration of voltage/transmissivity characteristics of an electro-optical device according to an embodiment of the present invention, and FIG. 1(*b*) is an illustration of variations in the voltage/transmissivity characteristics according to the type of liquid crystal.

Before describing an embodiment, the concept of a sub-field, which is an assumption about an electro-optical device according to the present embodiment, will be described. In general, in liquid crystal displays which use liquid crystal as the electro-optical material, the relationship between an effective voltage value applied to a liquid crystal layer (when a voltage is fixed and a pulse width of an on-voltage is changed) and relative transmissivity (or reflectivity) in, for example, a normally-black mode, in which black is displayed in a no-voltage-applied state, is shown in FIG. 1(*a*). Specifically, as the effective voltage value applied to a liquid crystal layer increases, the transmissivity also increases nonlinearly and saturates. The relative transmissivity used herein is obtained by normalization in which the minimum value and the maximum value of the amount of transmitted light are set as 0% and 100%, respectively.

It is assumed that the electro-optical device according to the present embodiment provides an 8-level gray-scale display and that gray-scale (gradation) data represented by 3 bits represents the transmissivity shown in the drawings. Concerning intermediate transmissivity, excluding 0% transmissivity and 100% transmissivity, effective voltage values applied to the liquid crystal layer are represented by V1, V2, . . . , and V6. Hitherto, these voltages are applied to the liquid crystal layer through data lines. As described in the background art, voltages V1, V2, . . . , and V6 corresponding to intermediate gray-scale levels are easily influenced by nonuniformity in characteristics of analog circuits such as a D/A converter circuit and an operational amplifier and by nonuniformity in various wiring resistances. In addition, variations may be often caused in pixels. As a result, it is difficult to produce high-quality and high-definition gray-scale display.

In order to solve this problem, first, the electro-optical device according to the present embodiment is configured to select a voltage to be applied instantaneously to the liquid crystal layer from, for example, either voltage VL (=0) corresponding to an L level or voltage VH corresponding to an H level.

With this arrangement, when voltage VL is applied to the liquid crystal layer over the time period of one frame (If), off-display is performed for the entire period. Hence, the transmissivity is 0%. When the ratio between a period for applying voltage VL to the liquid crystal layer and a period for applying voltage VH, within the time period of one field, is controlled so that the effective voltage values applied to the liquid crystal layer are V1, V2, . . . , and V6, gray-scale display in accordance with the voltages can be produced. When the voltage applied to the liquid crystal layer exceeds V7, the transmissivity is still 100% due to saturation.

When Va represents a voltage value at which the transmissivity starts rising from 0%, V1, V2, . . . , and V6 can be expressed as Va+(V1−Va), Va+(V2−Va), and Va+(V6−Va), respectively. In other words, when Vd represents an effective voltage value corresponding to required transmissivity, Vd is the sum of voltage value Va at which the transmissivity starts rising from 0% and Vd−Va. As described above, in the present embodiment, the ratio between a time period for applying voltage VL to the liquid crystal layer and a period for applying voltage VH within the period of one frame is controlled, and hence the effective voltage value applied to the liquid crystal layer is Vd.

Second, in the electro-optical device according to the present embodiment, a partial time period (first time period) of the time period of one time frame (1*f*) is reserved as a necessary period for generating an effective voltage value Vd-Va in accordance with the gray-scale data, and this time period is divided into a plurality of segments. Based on the gray-scale data, it is determined for each segment whether to apply voltage VL or voltage VH to the liquid crystal layer. In this way, an effective voltage having the value Vd-Va is applied to the liquid crystal layer. In the following description, the segments are referred to as sub-fields.

Third, in the electro-optical device according to the present embodiment, it is determined, in the remaining segment (second period: period other than the sub-fields) within the period of one frame (if), whether to apply voltage VL or voltage VH to the liquid crystal layer so that voltage value Va at which the transmissivity starts rising from 0% is applied as an effective voltage value to the liquid crystal layer. In the following description, a period for applying voltage VH to the liquid crystal layer is referred to as the Von period, and a period for applying voltage VL to the liquid crystal layer is referred to as the Voff period.

Concerning transmissivity characteristics relative to the voltage applied to the liquid crystal, a threshold voltage Vth varies in accordance with the composition of liquid crystal, the thickness (cell gap) of the liquid crystal layer, or the ambient temperature. The threshold voltage is the necessary voltage applied to the liquid crystal to obtain 10% transmissivity. In the example shown in FIG. 1(*b*), the threshold voltage Vth increases in the order of transmissivity characteristics X, Y, and Z. In the case of the transmissivity characteristic X, the necessary effective voltage for gray-scale display is within the range of Vax to Vbx. In the case of the transmissivity characteristic Z, the necessary effective voltage is within the range of Vaz to Vbz. The range of the necessary effective voltage for gray-scale display differs according to the type of liquid crystal. Voltage Va differs according to the type of liquid crystal and is a value defined in accordance with the threshold voltage Vth. In other words, the voltage Va changes in accordance with the threshold voltage Vth of the liquid crystal used in the electro-optical device. In contrast, concerning a driving circuit for the electro-optical device, a general-purpose driving circuit for driving various electro-optical devices is desirable.

Fourth, in the electro-optical device according to the present embodiment, within the remaining period (second period T2), the Von period for applying voltage VH to the liquid crystal layer is varied in accordance with the threshold voltage Vth of the liquid crystal used in the electro-optical device.

Figure 2:
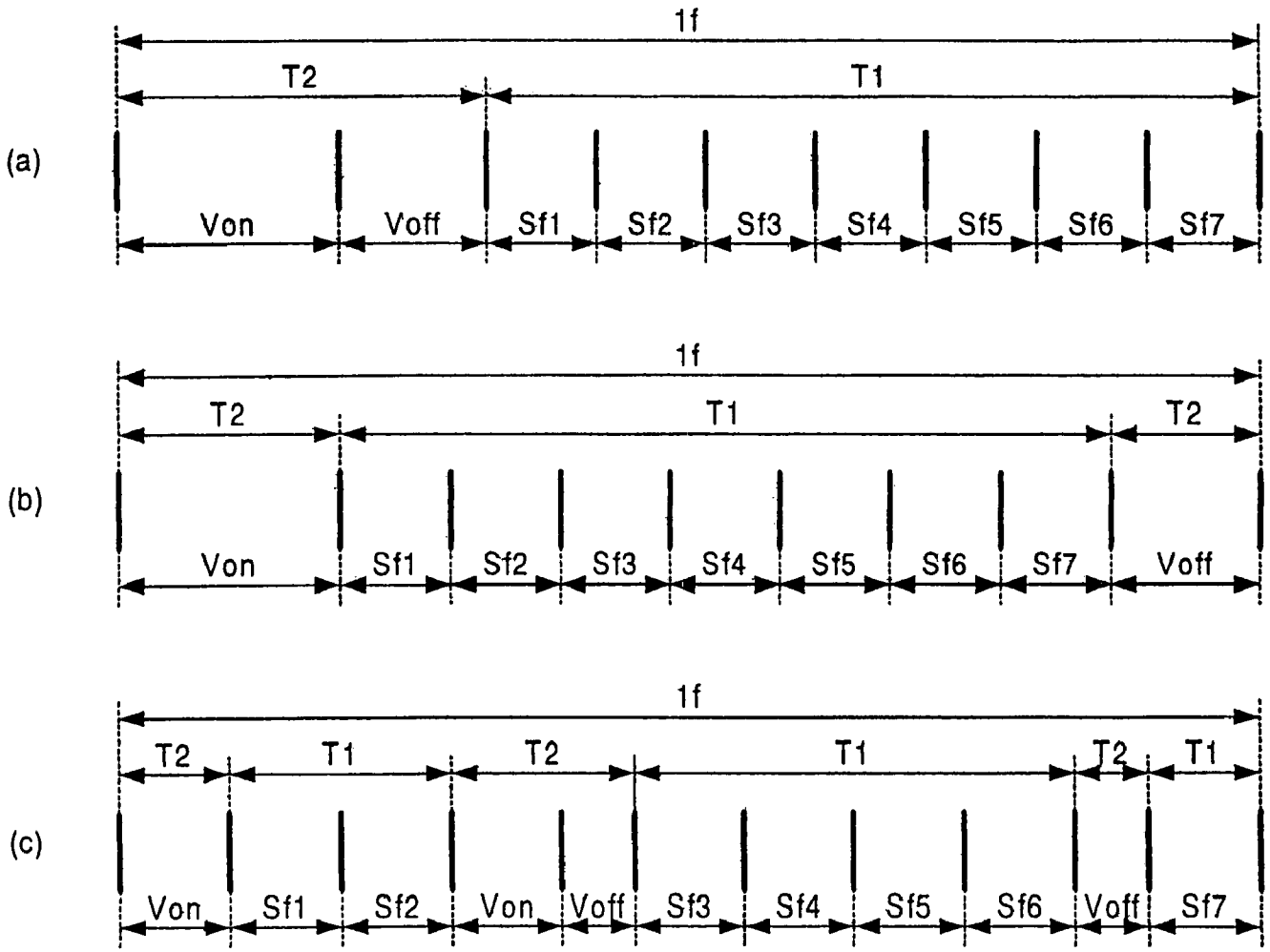
FIGS. 2(*a*), (*b*), and (*c*) are illustrations of the concepts of the Von period, the Voff period, and the sub-fields in the electro-optical device.

In FIG. 2, the division of one time frame into segments is shown. FIG. 2(*a*) illustrates that a second time period T2 starts immediately after the beginning of one time frame, and when the second time period ends, a first time period divided into sub-fields starts. FIG. 2(*b*) shows that the Von period and the Voff period in the second time period T2 are separated and that the first time period T1 is inserted therebetween. FIG. 2(*c*) illustrates that the second time period T2 is dispersed in the first time period T1. Since gray-scale display of the liquid crystal is determined in accordance with an effective voltage value applied to the liquid crystal, the sub-fields, the Von period, and the Voff period can be arranged in any manner within one time frame.

When the gray-scale data includes 3 bits as shown in FIG. 1(*a*), the above-described first time period T1 is divided into 7 segments, as shown in FIG. 2. The segments are referred to as sub-fields Sf1, Sf2, . . . , Sf6, and Sf7 for convenience. It is assumed that the transmissivity characteristic of the liquid crystal used in the electro-optical device is X shown in FIG. 1(*b*). In this case, it is necessary to apply an effective voltage which corresponds to voltage Vax to the liquid crystal for the second time period T2. The effective voltage value is given by a square root obtained by averaging the squares of instantaneous voltage values over one cycle (one time frame). The Von period to apply voltage VH is set to the period $(Vax/VH)^2$ relative to one time frame (If). Thus, for all pixels, it is possible to at least apply the voltage value Vax as an effective voltage to the liquid crystal layer regardless of the gray-scale data.

When the gray-scale data for a particular pixel is (001) (in other words, when producing a gray-scale display with the transmissivity of the pixel is 14.3%), the voltage VH is applied to the liquid crystal of the pixel for the sub-field Sf1 in the time period of one frame (If). For the other segments, voltage VL (=0) is applied. In this case, the time period of the sub-field Sf1 is set as time a period for applying the voltage value V1-Vax as an effective voltage. Application of voltage VH only for the sub-field Sf1 in the first time period means that voltage value V1 is applied to the liquid crystal as an effective voltage value. Accordingly, a gray-scale display in which the transmissivity of the pixel is 14.3% can be produced.

For example, when the gray-scale data is (010) (that is, when producing a gray-scale display with the transmissivity of the pixel is 28.6%), the voltage VH is applied to the liquid crystal layer of the pixel for the sub-field Sf1 and the sub-field Sf2 in the time period of one frame (if). At the same time, the voltage VL is applied for the remaining segments. The accumulated time period of the sub-field Sf1 and the sub-field Sf2 is set as a time period to apply the voltage value V2-Vax as an effective voltage. The effective voltage value applied to the liquid crystal layer for the time period of one time frame (1*f*) becomes the voltage V2. Hence, a gray-scale display in which the transmissivity of the pixel is 28.6% can be produced.

Similarly, when the gray-scale data is (011) (that is, when producing a gray-scale display with the transmissivity of the pixel is 42.9%), the voltage VH is applied to the liquid crystal layer of the pixel for the sub-fields Sf1 to Sf3 in the time period of one time frame (if). At the same time, the voltage VL is applied for the remaining segments. The accumulated time period of the sub-fields Sf1 to Sf3 is set as a time period for applying the voltage value V3-Vax as an effective voltage. The effective voltage value applied to the liquid crystal layer for the period of one time frame (1*f*) becomes voltage V3. Hence, a gray-scale display in which the transmissivity of the pixel is 42.9% can be produced. Similarly, the time periods of the sub-fields Sf4 to Sf7 are respectively set.

In this manner, the first time period is divided into seven sub-fields Sf1, Sf2, . . . , and Sf7. It is determined for each sub-field whether to apply voltage VH or voltage VL to the liquid crystal layer. For the second time period, it is determined whether to apply voltage VL or voltage VH to the liquid crystal layer so that voltage value Va which starts rising from 0% transmissivity, is applied to the liquid crystal layer as an effective voltage value. As a result, although the voltage applied to the liquid crystal layer has two values, i.e., VL and VH, it is possible to provide a gray-scale display corresponding to each transmissivity. The structure for achieving this will now be described with reference to the drawings.

<Overall Structure>

The electro-optical device according to the present embodiment is a liquid crystal device using liquid crystal as the electro-optical material. As described hereinafter, an element substrate and an opposing substrate are bonded with a predetermined separation, and the separation is filled with liquid crystal, that is, the electro-optical material. In the electro-optical device according to the present embodiment, a semiconductor substrate is used as the element substrate, on which transistors for driving pixels and peripheral driving circuits are formed. The electro-optical device in this example divides one frame into the Von period, the sub-fields Sf1 to Sf7, and the Voff period, in order, as shown in FIG. 2(*b*).

Figure 3:
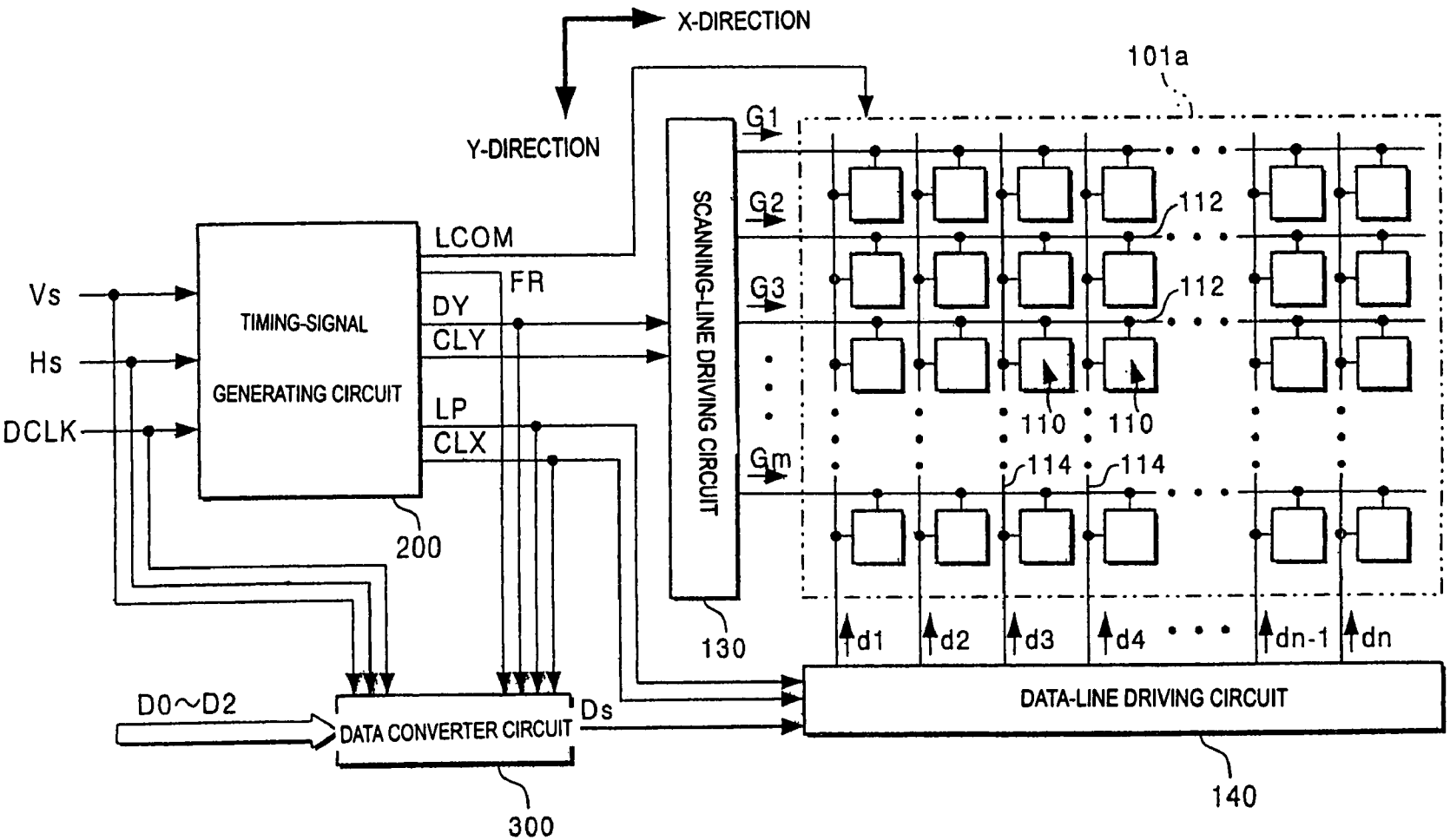
FIG. 3 is a block diagram of the electrical structure of the electro-optical device.

FIG. 3 is a block diagram of the electrical structure of the electro-optical device. In the drawing, a timing-signal generating circuit 200 generates various timing signals and clock signals, which are described hereinafter, in accordance with a vertical scanning signal Vs, a horizontal scanning signal Hs, and a dot clock signal DCLK, which are supplied from a high-level apparatus (not shown). First, an alternating current (AC) signal FR is a signal whose level is inverted every frame. Second, an AC drive signal LCOM is a signal whose level is inverted every frame and which is applied to a counter electrode on the opposing substrate. The phase of the AC drive signal LCOM lags by one clock pulse of a latch pulse LP relative to the AC signal FR. Third, a start pulse DY is a pulse signal which is output at the beginning of the Vo period, the Voff period, and each sub-field. Fourth, a clock signal CLY is a signal which defines a horizontal scanning interval of a scanning side (Y side). Fifth, the latch pulse LP is a pulse signal which is output at the beginning of the horizontal scanning interval. The latch pulse LP is output for level transitions (rising and falling) of the clock signal CLY. Sixth, a clock signal CLX is a signal which defines a so-called dot clock.

In a display region 101*a* on the element substrate, a plurality of scanning lines 112 is formed extending in the X (row) direction. Also, a plurality of data lines 114 is formed extending in the Y (column) direction. Pixels 110 are formed corresponding to intersections of the scanning lines 112 and the data lines 114 and the pixels are aligned in the form of a matrix. In order to simplify the description, the total number of scanning lines 112 is m, and the total number of data lines 114 is n (where m and n are integers equal to 2 or greater). Although an m×n matrix display device is described in the present embodiment, the present invention is not limited to the present embodiment.

<Structure of a Pixel>

Figure 4:
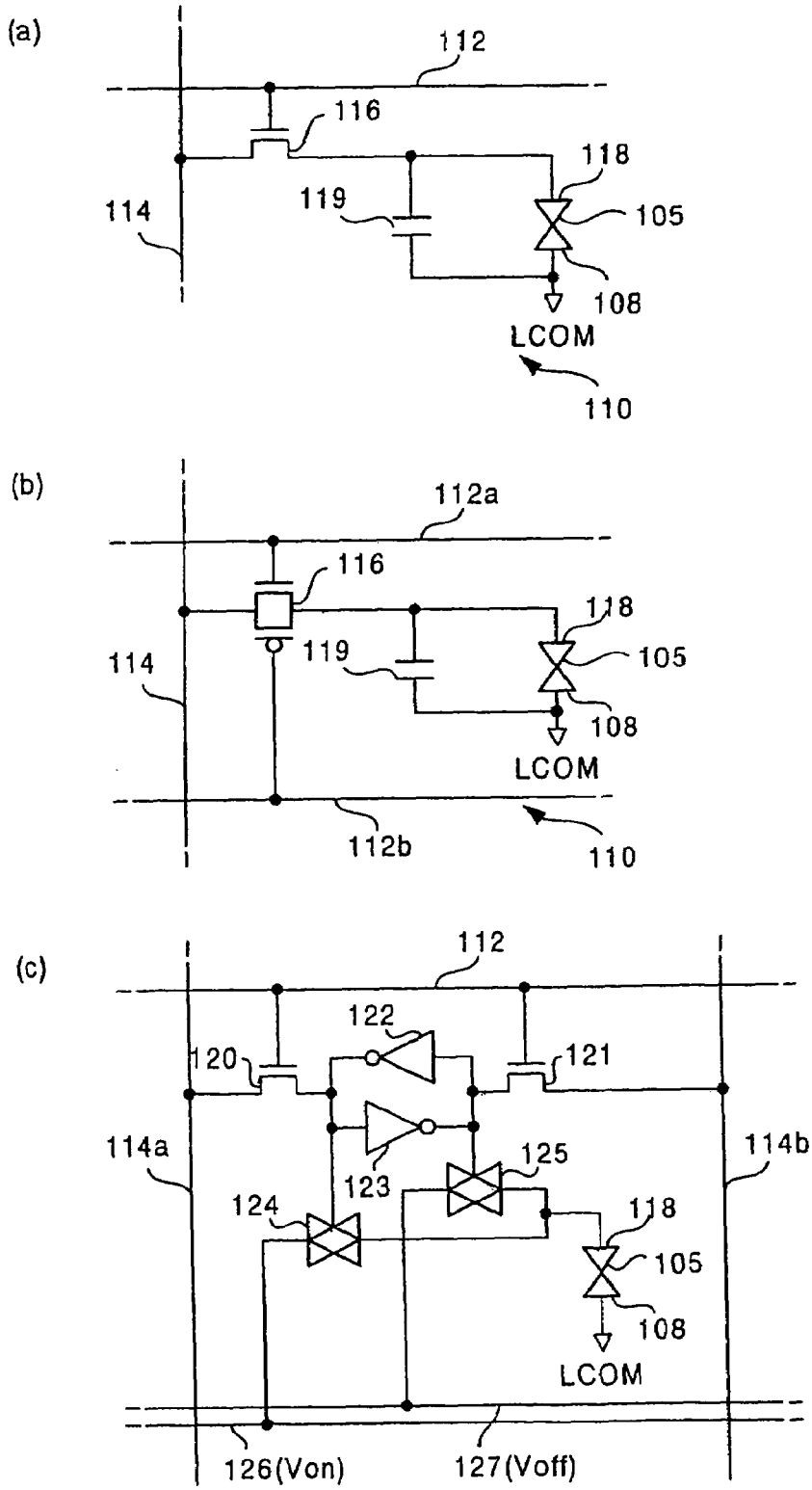
FIGS. 4(*a*), (*b*), and (*c*) are block diagrams of an example of a pixel in the electro-optical device, respectively.

The specific structure of each pixel 110 is, for example, as shown in FIG. 4(*a*). In this structure, the gate of a transistor (MOSFET) 116 is connected to the scanning line 112, the source is connected to the data line 114, and the drain is connected to a pixel electrode 118. Liquid crystal 105, which is the electro-optical material, is held between the pixel electrode 118 and a counter electrode 108, thereby forming a liquid crystal layer. As described hereinafter, the counter electrode 108 is a transparent electrode formed on the overall surface of the opposing substrate so that the counter electrode 108 is opposed to the pixel electrode 118. The potential of the counter electrode 108 is maintained at a constant value in general electro-optical devices. In contrast, in the electro-optical device according to the present embodiment, the above-described AC drive signal LCOM is applied, and hence the level of the potential is inverted every frame. A storage capacitor 119 is formed between the pixel electrode 118 and the counter electrode 108, and the storage capacitor 119 prevents leakage of charge accumulated in the liquid crystal layer. Although the storage capacitor 119 is formed between the pixel electrode 119 and the counter electrode 108, the storage capacitor 119 can be formed between the pixel electrode 119 and the ground potential GND or between the pixel electrode 119 and a gate line or the like.

In the structure shown in FIG. 4(*a*), only one channel-type transistor is used as the transistor 116. Thus, it is necessary to have an off-setting voltage. When the structure in which a P-channel transistor and an N-channel transistor are complementarily combined, as shown in FIG. 4(*b*), the influence of the off-setting voltage can be cancelled out. In this complementary structure, it is necessary to supply signals at exclusive levels as scanning signals. Hence, two scanning lines 112*a* and 112*b* are necessary for a single row of pixels 110.

Alternatively, the structure of the pixel 110 is shown in FIG. 4(*c*). In this example, the data line 114 consists of two data lines 114*a* and 114*b*. A data signal is supplied to the data line 114*a*, whereas an inverted data signal in which the polarity of the data signal is inverted is supplied to the data line 114*b*. The gates of transistors (MOSFETs) 120 and 121 are connected to the scanning line 112. The source of the transistor 120 is connected to the data line 114*a*, and the source of the transistor 121 is connected to the data line 114*b*. Between the drains of the transistors 120 and 121, inverters 122 and 123 are provided to form a latch circuit. In addition, voltage feeding lines 126 and 127 for feeding the on-voltage Von and the off-voltage Voff, respectively, are provided. These voltages are selectively applied to the pixel electrode 118 through transfer gates 124 and 125. The transfer gates 124 and 125 are configured to enter an on state when the level of a respective control input terminal is the H level and to enter an off state when the level is the L level.

In this example, when the voltage of the scanning line 112 is at the H level, the transistors 120 and 121 enter an on state. A data signal and an inverted data signal are supplied to control input terminals of the transfer gates 124 and 125, respectively. When the level of the data signal is H level, on-voltage Von is applied to the pixel electrode 118. When the level is L level, on-voltage Voff is applied to the pixel electrode 118. In contrast, when the voltage of the scanning line 112 is at the L level, the transistors 120 and 121 enter an on state. The immediately preceding state is maintained by the latch circuit (the inverters 122 and 123).

<Start-Pulse Generating Circuit>

As described above, according to the present embodiment, one time frame is divided into a first time period T1 for applying a two-level voltage to the liquid crystal layer in accordance with the gray-scale data in each sub-field and a second period T2 for applying a two-level voltage to the liquid crystal layer in accordance with the threshold value of the liquid crystal.

The switching among the Von period, the Voff period, and the sub-fields is controlled by the start pulse DY. The start pulse DY is generated in a timing-signal generating circuit 200. The structure of a start-pulse generating circuit, which is in the timing-signal generating circuit 200, for generating the start pulse DY is described.

Figure 5:
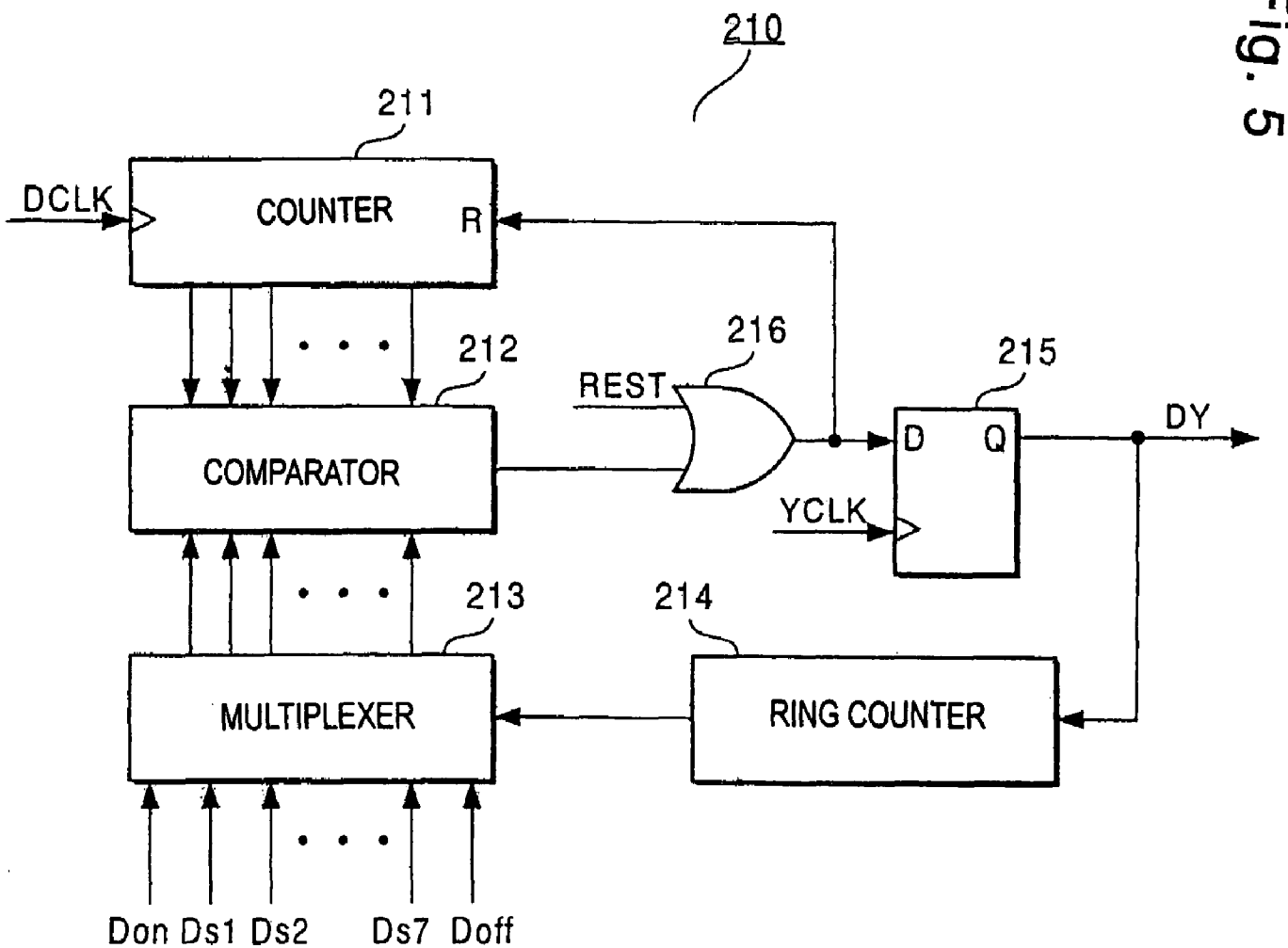
FIG. 5 is a block diagram of the structure of a start-pulse generating circuit in the electro-optical device.

FIG. 5 is a block diagram of an example of the structure of the start-pulse generating circuit. As shown in FIG. 5, a start-pulse generating circuit 210 includes a counter 211, a comparator 212, a multiplexer 213, a ring counter 214, a D flip-flop 215, and an OR circuit 216.

The counter 211 counts dot clocks DCLK. An output signal of the OR circuit 216 resets the counter value. At the beginning of a field, a reset signal RSET, which is at the H level for the period of one cycle of a dot clock DCLK, is supplied to one input terminal of the OR circuit 216. Thus, the counter value of the counter 211 is at least reset at the beginning of a frame.

The comparator 212 compares the counter value of the counter 211 and an output data value of the multiplexer 213. When both values match each other, the comparator 212 outputs a matching signal which is at the H level. The multiplexer 213 selectively outputs data Don, Ds1, Ds2, . . . , Ds7, and Doff based on the count result of the ring counter 214 for counting the number of start pulses DY. The data Don, Ds1, Ds2, . . . , Ds7, and Doff correspond to the time periods Von, Sf1, Sf2, . . . , Sf7, and Voff shown in FIG. 2(*b*). The data Don is determined in accordance with the threshold voltage Vth of the liquid crystal and can be varied. For example, data Don can be set for each product model of electro-optical devices. Alternatively, the data Don can be adjusted at the time of shipment in order to compensate for variations among products. Also, a control button can be provided so that a user can perform adjustment. When the user operates the control button, the value of the data Don can be changed. In addition, the temperature of the liquid crystal display or the ambient temperature around the liquid crystal display can be detected by a temperature sensor. Based on the detected temperature, the value of the data Don can be changed in accordance with temperature characteristics of the liquid crystal. Since the sum of the value of the data Don and the value of the data Doff is constant, an increase or a decrease in the value of the data Don will cause appropriate change in the value of the data Doff. When the duration of the Von period is changed in accordance with the temperature characteristics of the liquid crystal, the ambient temperature follows the change. As a result, an effective voltage value applied to the liquid crystal can be changed. It is therefore possible to maintain a constant displayable gray scale and contrast ratio even when the temperature changes.

When the counter value of the counter reaches the boundary of the sub-fields, the comparator 212 outputs a matching signal. Since the matching signal is fed back to a reset terminal of the counter 211 through the OR circuit 216, the counter 211 again starts counting at the boundary of the sub-fields. The D flip-flop 215 latches an output signal from the OR circuit 216 using a Y-clock signal YCLK and generates the start pulse DY.

<Scanning-Line Driving Circuit>

Referring back to FIG. 3, the scanning-line driving circuit 130 is a so-called Y shift register. The scanning-line driving circuit 130 transfers the start pulse DY supplied at the beginning of a sub-field in accordance with the clock signal CLY and exclusively supplies the start pulse DY to the scanning lines 112 one after another as scanning signal,"G1, G2, G3, . . . , Gm.

<Data-Line Driving Circuit>

Figure 6:
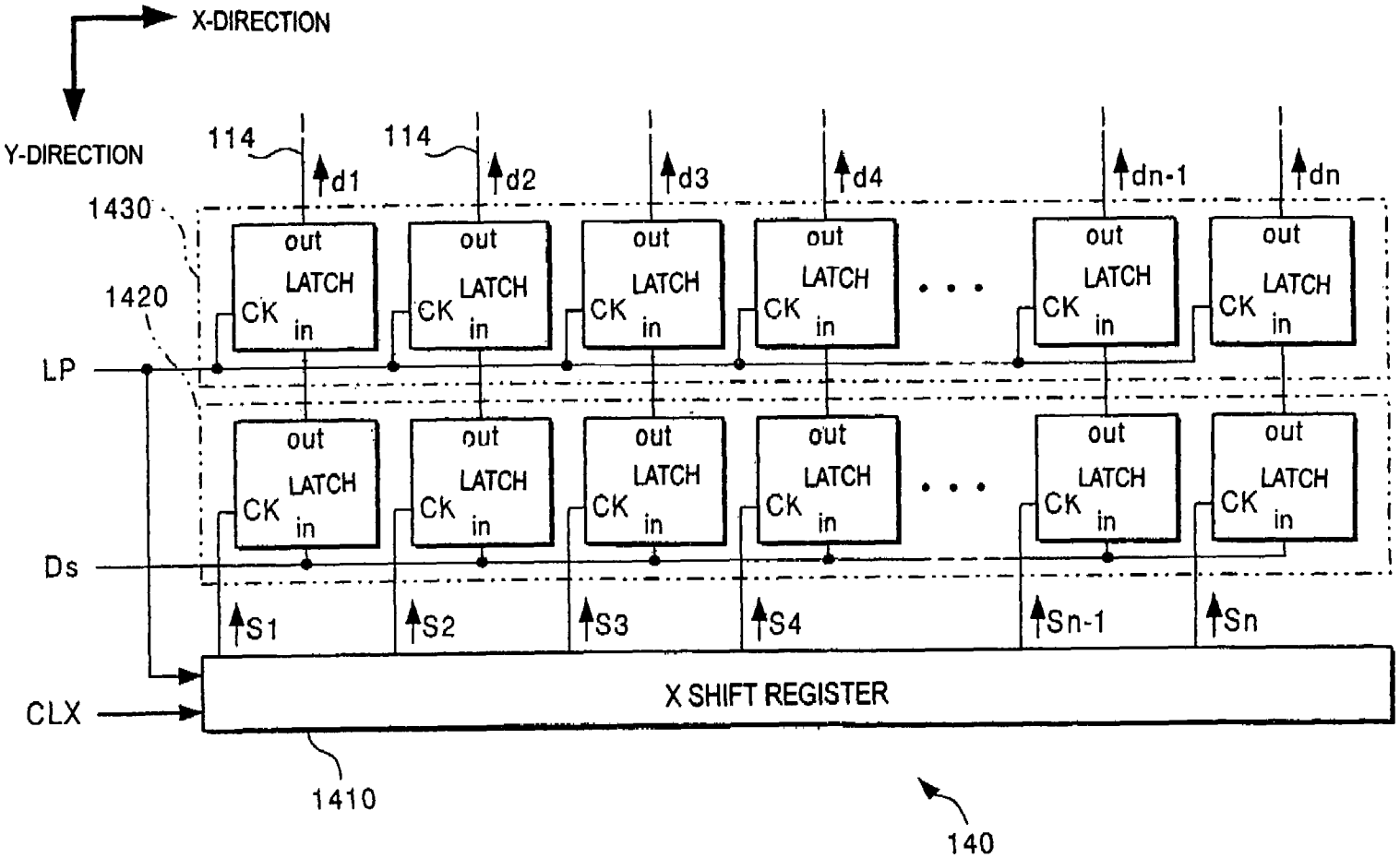
FIG. 6 is a block diagram of the structure of a data-line driving circuit in the electro-optical device.

The data-line driving circuit 140 sequentially latches n two-level signals Ds within a particular horizontal scanning interval, the number n corresponding to the number of data lines 114, and thereafter simultaneously supplies the latched n two-level signals Ds in the subsequent horizontal scanning interval to the corresponding data lines 114 as data signals d1, d2, d3, . . . , dn, respectively. The specific structure of the data-line driving circuit 140 is shown in FIG. 6. Specifically, the data-line driving circuit 140 includes an X shift register 1410, a first latch circuit 1420, and a second latch circuit 1430. The X shift register 1410 transfers the latch pulse LP supplied at the beginning of a horizontal scanning interval in accordance with the clock signal CLX and exclusively supplies the latch pulse LP as latch signals S1, S2, S3, . . . , Sn one after another. The first latch circuit 1420 sequentially latches the two-level signals Ds at the falling edge of latch signals S1, S2, S3, . . . , Sn. The second latch circuit 1430 simultaneously latches the two-level signals Ds latched by the first latch circuit 1420 at the falling edge of the latch pulse LP and supplies the two-level signals Ds as data signals d1, d2, d3, . . . , dn to the data lines 114, respectively.

<Data Converter Circuit>

A data converter circuit 300 will now be described. In order to write the H level or the L level in accordance with a gray-scale level in each of the sub-fields Sf1 to Sf7, some kind of conversion of the gray-scale data which correspond to pixels is necessary. In order to apply the voltage Va, at which the transmissivity characteristic of the liquid crystal starts rising from 0%, as an effective voltage by writing a two-level voltage, it is necessary to apply the H-level voltage to the liquid crystal layer during the Von period.

To this end, the data converter circuit 300 shown in FIG. 3 is provided. Specifically, the data converter circuit 300 converts 3-bit gray-scale data D0 to D2, which is supplied in synchronization with the vertical scanning signal Vs, the horizontal scanning signal Hs, and the dot clock signal DCLK and which corresponds to each pixel, into a two-level signal Ds in each of the sub-fields Sf1 to Sf7. Also, the data converter circuit 300 supplies the H-level two-level signal Ds to each pixel for the Von period and supplies the L-level two-level signal Ds to each pixel during the Voff period.

In the data converter circuit 300, it is necessary to recognize the present sub-field within one frame or to recognize whether the present period is the Von period or the Voff period. To this end, for example, the following method can be used. Specifically, since AC driving is performed in the present embodiment, the potential of the counter electrode 108 is inverted every frame by the AC drive signal LCOM. A counter for counting the start pulses DY can be provided in the data converter circuit 300, in which the count result is reset by level transitions (rising and falling) of the AC signal FR. By referring to the count result, it is possible to recognize the present sub-field or the like.

The data converter circuit 300 is required to convert the gray-scale data D0 to D2 into two-level signals Ds in accordance with the level of the AC signal FR. Specifically, when the AC signal FR is at the L level, the data converter circuit 300 outputs two-level signals Ds corresponding to the gray-scale data D0 to D2 in accordance with the contents shown in FIG. 7(*a*). When the AC signal FR is at the H level, the data converter circuit 300 outputs the two-level signals Ds in accordance with the contents shown in FIG. 7(*b*). In addition, it is necessary to effectively apply the H-level voltage to the liquid crystal layer during the Von period and apply the L-level voltage during the Voff period. For these periods, the data converter circuit 300 outputs the two-level signals Ds shown in FIG. 7 in accordance with the level of the AC signal FR.

The two-level signals Ds are required to be output in synchronization with the operation of the scanning-line driving circuit 130 and the data-line driving circuit 140. Therefore, the start pulse DY, the clock signal CLY in synchronization with horizontal scanning, the latch pulse LP defining the beginning of a horizontal scanning interval, and the clock signal CLX corresponding to the dot clock signal are supplied to the data converter circuit 300. As described above, in the data-line driving circuit 140, the first latch circuit 1420 dot-sequentially latches two-level signals in a particular horizontal scanning interval, and in the subsequent horizontal scanning interval, the second latch circuit 1430 simultaneously supplies the two-level signals as data signals d1, d2, d3, . . . , dn to the respective data lines 114. The data converter circuit 300 outputs the two-level signals Ds with a timing preceding the operation of the scanning-line driving circuit 130 and the data-line driving circuit 140 by one horizontal scanning interval.

<Operation>

Figure 8:
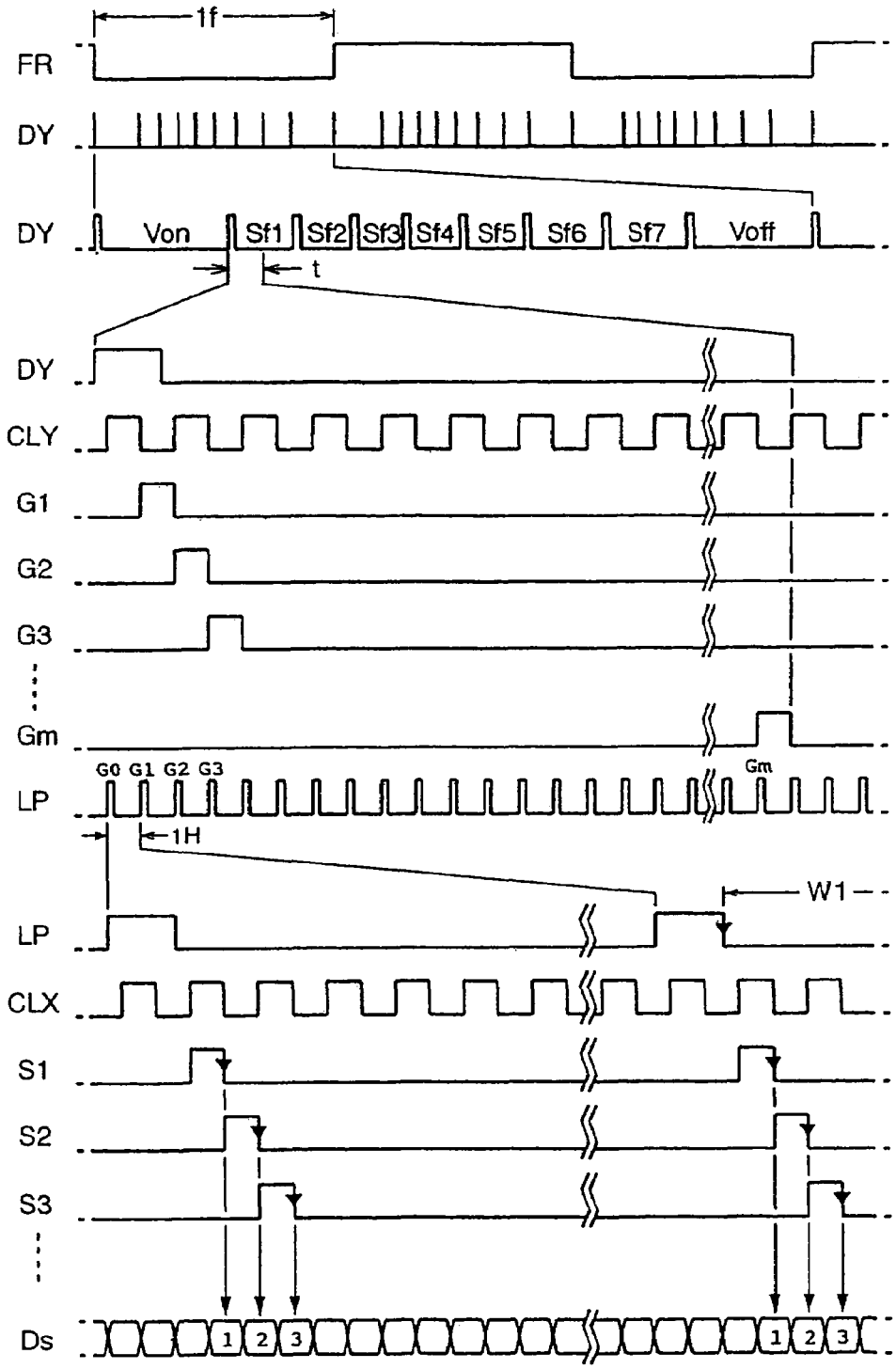
FIG. 8 is a timing chart showing the operation of the electro-optical device.

The operation of the electro-optical device according to the above-described embodiment will now be described. FIG. 8 is a timing chart for describing the operation of the electro-optical device.

The AC signal FR is a signal whose level is inverted every frame (if). A start pulse DY is supplied at the beginning of the Von period, the Voff period, and each sub-field.

When the start pulse DY is supplied in one time frame (if) in which the AC signal FR is at the L level, the scanning signals G1, G2, G3, . . . , Gm are exclusively output one after another for a period (t) based on the clock signal CLY in the scanning-line driving circuit 130 (see FIG. 3). The period (t) is set as a period shorter than the shortest sub-field.

The scanning signals G1, G2, G3, . . . , Gm each have a pulse width which corresponds to a half period of the clock signal CLY. When the clock signal CLY first rises after the start pulse DY has been supplied, the scanning signal G1 which corresponds to the first scanning line 112 from the top is output, which is 7 delayed at least by a half period of the clock signal CLY. Within a time period from the supplying of the start pulse DY to the outputting of the scanning signal G1, one shot (G0) of the latch pulse LP is supplied to the data-line driving circuit 140.

The operation in which one shot (G0) of the latch pulse LP is supplied will now be discussed. When one shot (G0) of the latch pulse LP is supplied to the data-line driving circuit 140, the latch signals S1, S2, S3, . . . , Sn are exclusively output one after another in a horizontal scanning interval (1H) based on the clock signal CLX in the data-line driving circuit 140 (see FIG. 6). The latch signals S1, S2, S3, . . . , Sn each have a pulse width which corresponds to a half period of the clock signal CLX.

At the falling edge of the latch signal S1, the first latch circuit 1420 shown in FIG. 6 latches the two-level signal Ds for the pixel 110 which corresponds to the intersection of the first scanning line 112 from the top and the first data line 114 from the left. Next, at the falling edge of the latch signal S2, the first latch circuit 1420 latches the two-level signal Ds for the pixel 110 which corresponds to the intersection of the first scanning line 112 from the top and the second data line 114 from the left. From this time onward, the first latch circuit 1420 similarly latches the two-level signal Ds for the pixel 110 which corresponds to the first scanning line 112 from the top and the n-th data line 114 from the left.

Accordingly, the two-level signals Ds for a row of pixels which correspond to the intersections with the first scanning line 112 from the top are dot-sequentially latched by the first latch circuit 1420. It goes without saying that the data converter circuit 300 converts the gray-scale data D0 to D2 for each pixel into the two-level signal Ds and outputs the two-level signal Ds in accordance with a latch timing of the first latch circuit 1420. Since it is assumed that the AC signal FR is at the L level, reference to the table shown in FIG. 7(*a*) is made. The two-level signal Ds which corresponds to the sub-field Sf1 is output in accordance with the gray-scale data D0 to D2.

When the clock signal CLY falls and the scanning signal G1 is output, the first scanning line 112 from the top, as shown in FIG. 3, is selected. As a result, all the transistors 116 for the pixels 110 which correspond to the intersections with the scanning line 112 are turned on. In contrast, when the clock signal CLY falls, the latch pulse LP is output. With the timing in which the latch pulse LP falls, the second latch circuit 1430 simultaneously supplies the two-level signals Ds which are dot-sequentially latched by the first latch circuit 1420 as the data signals d1, d2, d3, . . . , dn to the respective data lines 114. The data signals d1, d2, d3, . . . , dn are simultaneously written to the pixels 110 in the first row from the top.

In parallel with the writing, the two-level signals Ds for a row of pixels which correspond to the intersections with the second scanning line 112 from the top, as shown in FIG. 3, are dot-sequentially latched by the first latch circuit 1420.

From this time onward, similar operations are repeated until the scanning signal Gm which corresponds to the m-th scanning line 112 is output. In other words, in a horizontal scanning interval (1H) in which a particular scanning signal Gi (where i is an integer which satisfies 1<i<m) is output, writing of the data signals d1 to dn for a row of pixels 110 which correspond to the i-th scanning line 112 and dot-sequential latching of the two-level signals Ds which correspond to a row of pixels 110 which correspond to the (i+1)th scanning line 112 are performed in parallel. The data signals written to the pixels 110 are maintained until writing is performed for the subsequent sub-field Sf2.

From this time onward, similar operations are repeated until the start pulse DY which defines the beginning of a sub-field is supplied. The data converter circuit 300 (see FIG. 1) converts the gray-scale data D0 to D2 into the two-level signal Ds by referring to the corresponding sub-field item from among the sub-fields Sf1 to Sf7.

During the Von period and the Voff period, writing is similarly performed. In the Von period, the two-level signal Ds is always at the H level. In the Voff period, the level of the two-level signal Ds is always at the L level.

When the AC signal FR is inverted to the H level after one time frame has passed, similar operations are repeated for each sub-field. Concerning conversion of the gray-scale data D0 to D2 into the two-level signal Ds, reference to the table shown in FIG. 7(*b*) is made. In the Von period and the Voff period, reference to the table shown in FIG. 7(*b*) is made.

Figure 9:
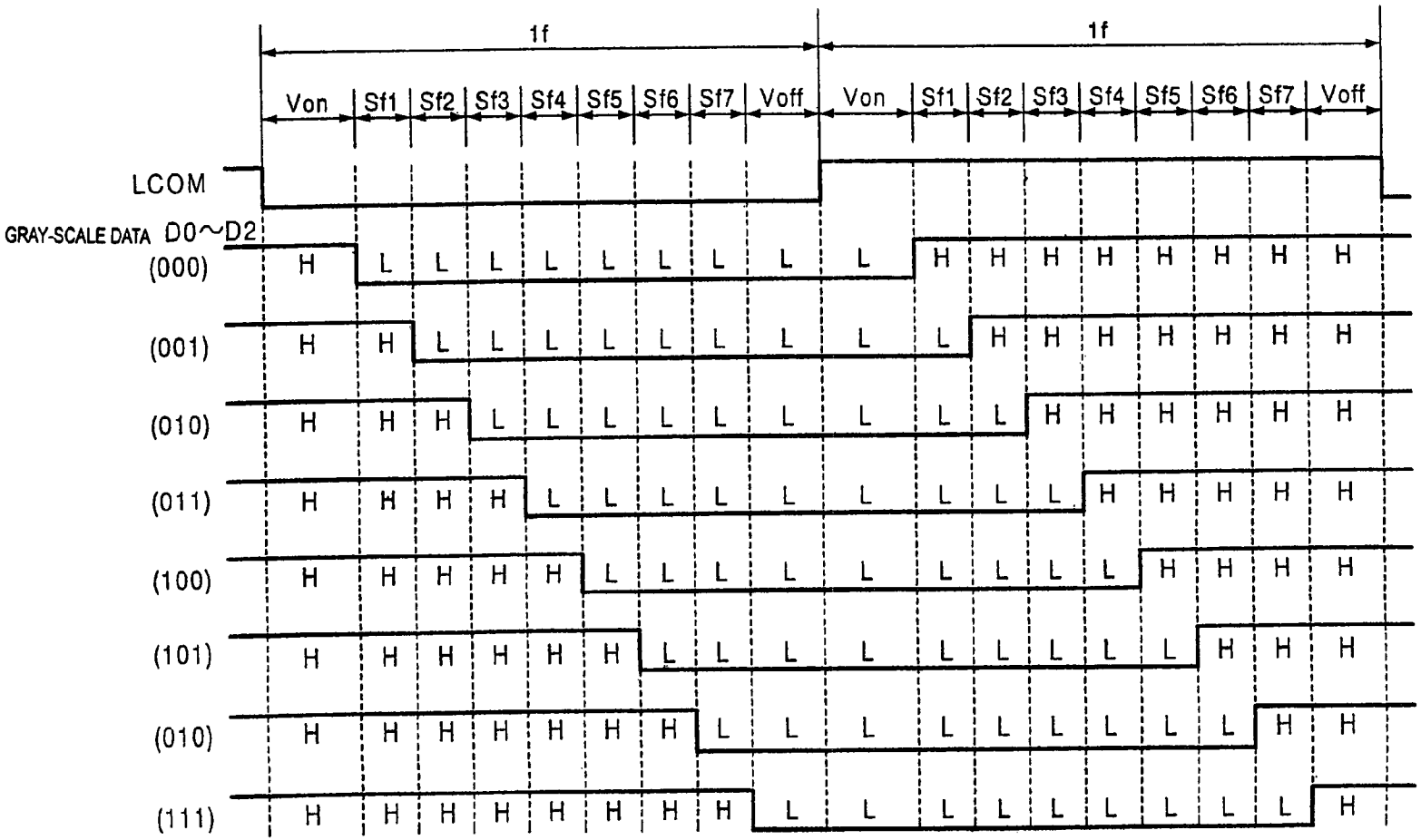
FIG. 9 is a timing chart showing a voltage applied to an opposing substrate and a voltage applied to pixel electrodes in the electro-optical device in time frame units.

Next, a voltage applied to the liquid crystal layer of the pixel 110 by performing the above operation will be described. FIG. 9 is a timing chart describing the gray-scale data and waveforms of voltage applied to the pixel electrode 118 in the pixel 110.

For example, when the AC drive signal LCOM is at the L level, and when the gray-scale data D0~D2 for a particular pixel is (000), as a result of conversion in accordance with the contents shown in FIG. 7(*a*), as shown in FIG. 9, the H level is written to the pixel electrode 118 in the pixel for the Von period, and the L level is written to the pixel electrode 118 in the pixel for the remaining time period. As described above, when the H level is written during the Von period, the effective voltage value applied to the liquid crystal layer is Va. Hence, the transmissivity of the pixel is 0% which corresponds to the gray-scale data (000).

When the gray-scale data D0~D2 for a particular pixel is (100), as a result of conversion in accordance with the contents shown in FIG. 7(*a*), as shown in FIG. 9, the H level is written to the pixel electrode 118 in the pixel for the Von period and for the sub-fields Sf1 to Sf4, and the L level is written for the subsequent sub-fields Sf5 to Sf7 and for the Voff period. The ratio of the time period of the sub-fields Sf1 to Sf4 to one frame (if) corresponds to (V4-Va), and the ratio of the Von period to one time frame (If) corresponds to (Va). The effective voltage value applied, for one time frame, to the pixel electrode 118 in the pixel is V4. Hence, the transmissivity of the pixel is 57.1% which corresponds to the gray-scale data (100). Descriptions of the other gray-scale data will be omitted.

When the gray-scale data D0 to D2 for a particular pixel is (111), as a result of conversion in accordance with the contents shown in FIG. 7(*a*), as shown in FIG. 9, the H level is written over one time frame (If) except for the Voff period. The transmissivity of the pixel is 100% which corresponds to the gray-scale data (I 1).

When the AC drive signal LCOM is at the H level, an inverted level, compared with the case of the H level, is applied to the pixel electrode 118. When the average value of the H level and the L level is used as a reference voltage, and when the AC drive signal LCOM is at the H level, the polarity of a voltage applied to each liquid crystal layer is the inverse of the voltage applied when the AC drive signal LCOM is at the L level, and absolute values of the two voltages are equal. Thus, application of a direct current (DC) component to the liquid crystal layer is prevented. As a result, deterioration of the liquid crystal 105 is prevented.

According to the electro-optical device of the present embodiment, one time frame (if) is divided into the sub-fields Sf1 to Sf7 in accordance with voltage ratios of gray-scale characteristics. By writing the H level or the L level to pixels for each sub-field, the effective voltage value in one time frame is controlled. The data signals d1 to dn supplied to the data lines 114 are at the H level or the L level, i.e., two levels. Thus, peripheral circuits such as driving circuits do not require circuits such as a high-accuracy D/A converter circuit and an operational amplifier for processing analog signals. In this way, the circuit configuration is substantially simplified, and the cost of the overall device is reduced. Since the data signals d1 to dn supplied to the data lines 114 have two levels, display unevenness due to non-uniformity in device characteristics and wiring resistances does not occur. According to the electro-optical device of the present embodiment, a high-quality and high-definition gray-scale display can be produced.

Apart from the sub-fields, the Von period and the Voff period are allocated within one time frame, and the duration of the Von period can be adjusted by the voltage Va at which the transmissivity characteristics of the liquid crystal starts rising. Accordingly, the embodiment can be applied to electro-optical devices using various types of liquid crystal, thereby increasing the versatility of the device.

In the above embodiment, the level of the AC drive signal LCOM is inverted with a time period of one frame. However, the present invention is not limited to this embodiment. For example, the level inversion with a time period of two or more time frames can be performed. In the above-described embodiment, the data converter circuit 300 detects the present sub-field by counting the start pulses DY and by resetting the count result in accordance with transitions of the AC signal FR. When the level of the AC signal FR is inverted with a time period of two time frames, it is necessary to supply some kind of a signal for defining a time frame.

A voltage applied to each pixel may be shifted due to characteristics of the transistor 116, the storage capacitor 119, and the capacitance of the liquid crystal. In such cases, the voltage LCOM applied to the counter electrode 110 may be shifted in accordance with a voltage shifted amount.

<Application (1)>

In the above-described embodiment, it is necessary to complete writing for each sub-field within the time period (t) which is shorter than the minimum sub-field. At the same time, in the above-described embodiment, an 8-level gray-scale display is produced. In order to increase the number of levels in the gray-scale display, such as 16-level gray-scale display, 64-level gray-scale display, and the like, it is necessary to further shorten the time period of each sub-field and to complete writing for each sub-field within a shorter period of time.

Since the driving circuits, and particularly the X shift register 1410 in the data-line driving circuit 140, operate in the vicinity of an upper limit, it is impossible to increase the number of levels in the gray-scale display if the structure remains unaltered. An application is described in which improvements in this regard are made.

Figure 10:
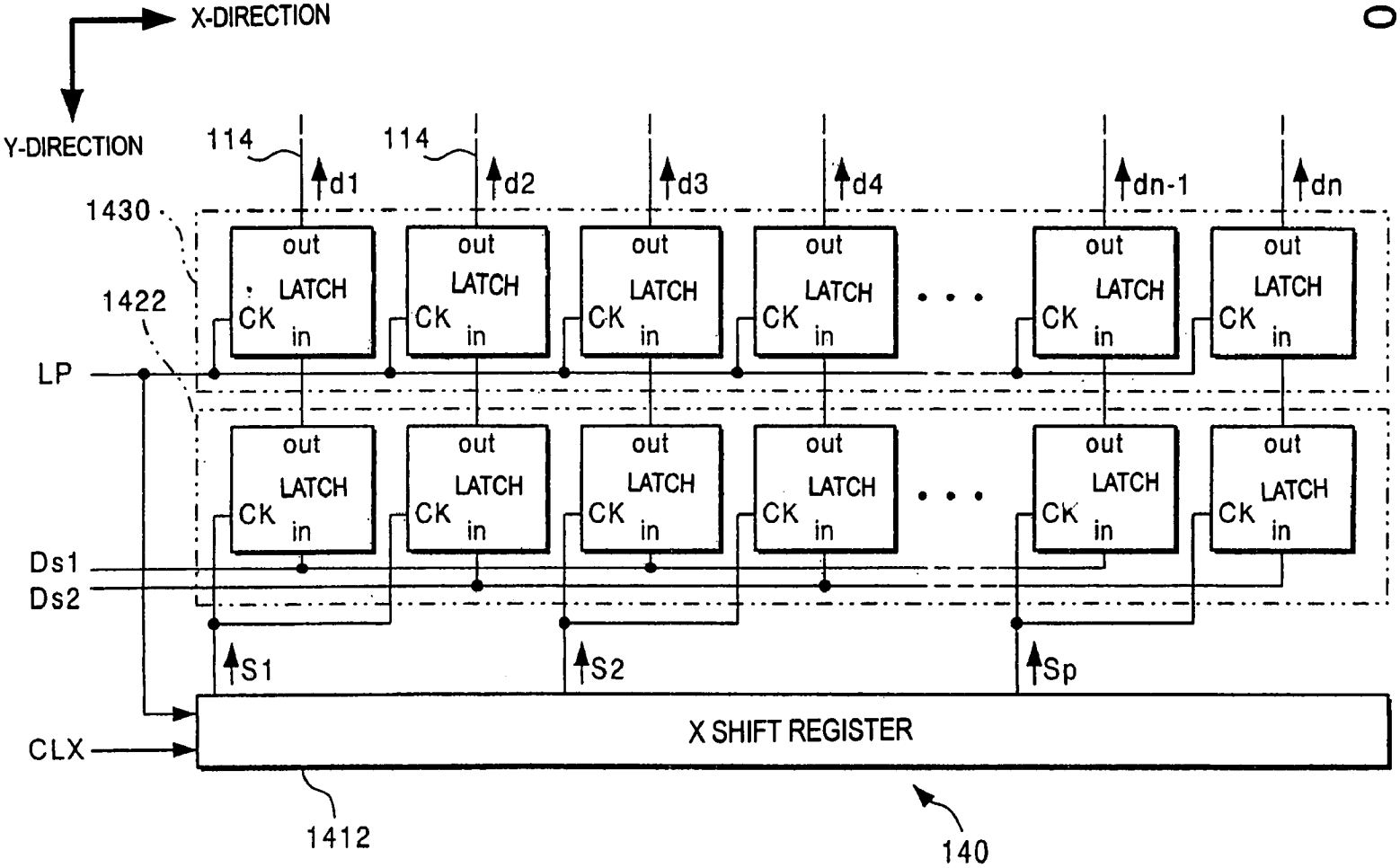
FIG. 10 is a block diagram of an application of the data-line driving circuit in the electro-optical device.

FIG. 10 is a block diagram of the structure of a data-line driving circuit in an electro-optical device according to the application. In this diagram, an X shift register 1412 is similar to the X shift register 1410 shown in FIG. 6 in transferring the latch pulse LP in accordance with the clock signal CLX. The X shift register 1412 differs from the X shift register 1410 in that the number of stages is reduced to half. In other words, it is assumed that an integer p satisfies n=2p. The X shift register 1412 sequentially outputs the latch signals S1, S2, . . . , Sp.

In this application, a two-level signal is supplied using two different lines, that is, a two-level signal Ds1 to be supplied to the odd-numbered data lines 114 from the left and a two-level signal Ds2 to be supplied to the even-numbered data lines 114. Concerning a first latch circuit 1422, a section for latching the two-level signal Ds1 which corresponds to the odd-numbered data lines 114, is paired with a section for latching the two-level signal Ds2 which corresponds to the remaining even-numbered data lines 114, thus simultaneously performing latching at the falling edge of a single latch signal.

Figure 11:
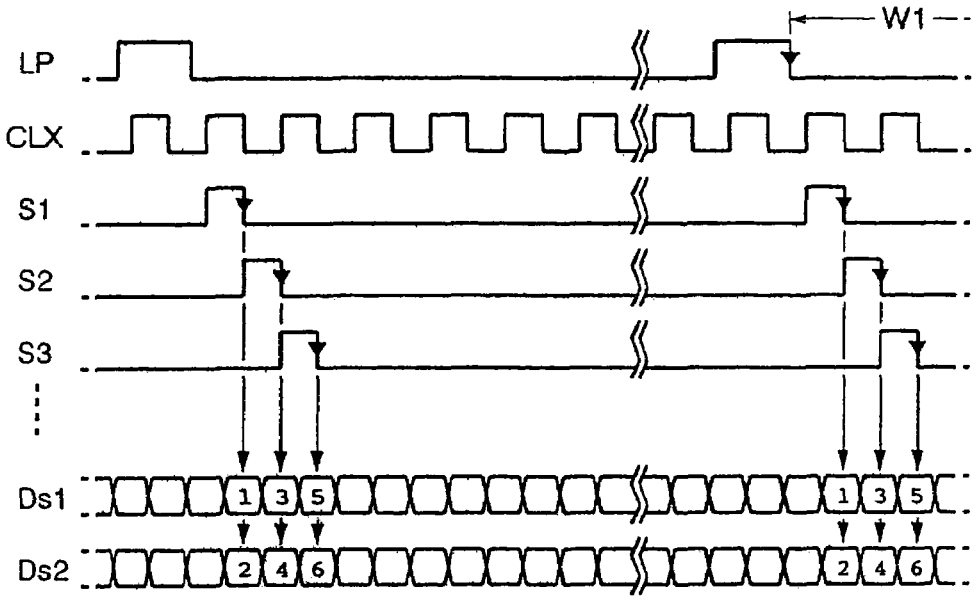
FIG. 11 is a timing chart showing the operation of the data-line driving circuit according to the application.

According to the data-line driving circuit 140, as shown in FIG. 11, the two-level signals Ds1 and Ds2 for two pixels are simultaneously latched by each of the latch signals S1, S2, S3, . . . It is thus possible to reduce the necessary horizontal scanning interval to half while maintaining the frequency of the clock signal CLX as that in the above-described embodiment. Based on "n" which corresponds to the total number of data lines 114, the number of stages in a unit circuit which forms the X shift register 1412 can be reduced to "p" which is half of "n". Hence, the structure of the X shift register 1412 can be simplified compared with the X shift register 1410 (shown in FIG. 6).

Since the number of stages in a unit circuit which forms the X shift register 1412 is reduced to half, if the necessary horizontal scanning interval is the same, it means that the clock signal CLX can be reduced to half. With the same horizontal scanning interval, it is possible to reduce power consumption in accordance with an operating frequency.

According to this application, the number of sections in the first latch circuit 1422 for simultaneously latching signals using the latch signals is "2". It is also possible to use "3" or greater. In this case, two-level signals are supplied using different lines in accordance with the number of sections.

<Application (2)>

In the above-described embodiment, writing for the Von period, the Voff period, and each sub-field are completed within the time period (t). Concerning a particular sub-field, in a time period from the completion of writing to the beginning of the subsequent sub-field, only the operation of maintaining a voltage written in the liquid crystal layer of each pixel is performed.

In contrast, the clock signal CLX having an extremely high frequency is supplied to the foregoing drive circuits, particularly to the data-line driving circuit 140. In general, shift registers are provided with numerous clocked inverters in which a clock signal is input to the gate thereof. In view from the timing-signal generating circuit 200 which is the supply source of the clock signal CLX, the X shift register 1410 (1412) is a capacitive load.

When the clock signal CLX is supplied within the time period to perform the above-described maintaining operation, the power is purposelessly consumed by the capacitive load. As a result, the power consumption is increased. An application will now be described in which improvements in this regard are made.

Figure 12:
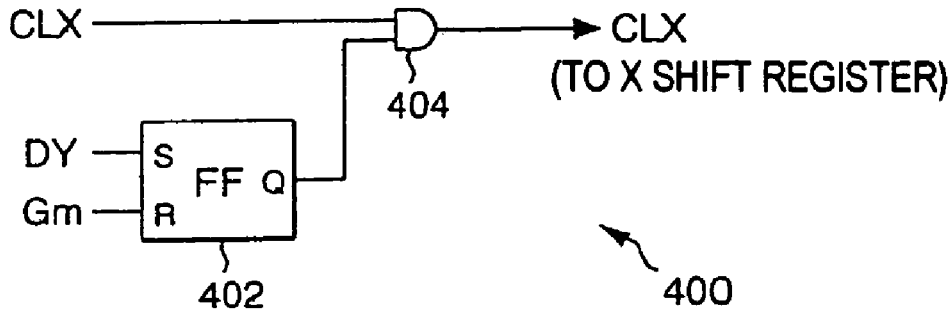
FIG. 12 is a block diagram of the structure of a clock-signal supply control circuit in an application of the electro-optical device.

In this application, a clock-signal supply control circuit 400 shown in FIG. 12 is inserted before the clock signal CLX output from the timing-signal generating circuit 200 reaches the X shift register 1410 (1420). The clock-signal supply control circuit 400 includes an RS flip-flop 402 and an AND circuit 404. Concerning the RS flip-flop 402, the start pulse DY is input to a set input terminal S and the scanning signal Gm is input to a reset input terminal R. The AND circuit 404 obtains the AND signal of the clock signal CLX supplied from the timing-signal generating circuit 200 and a signal output from an output terminal Q of the RS flip-flop 402 and supplies the AND signal as the clock signal CLX to the X shift register 1410 (1420) in the data-line driving circuit 140.

Figure 13:
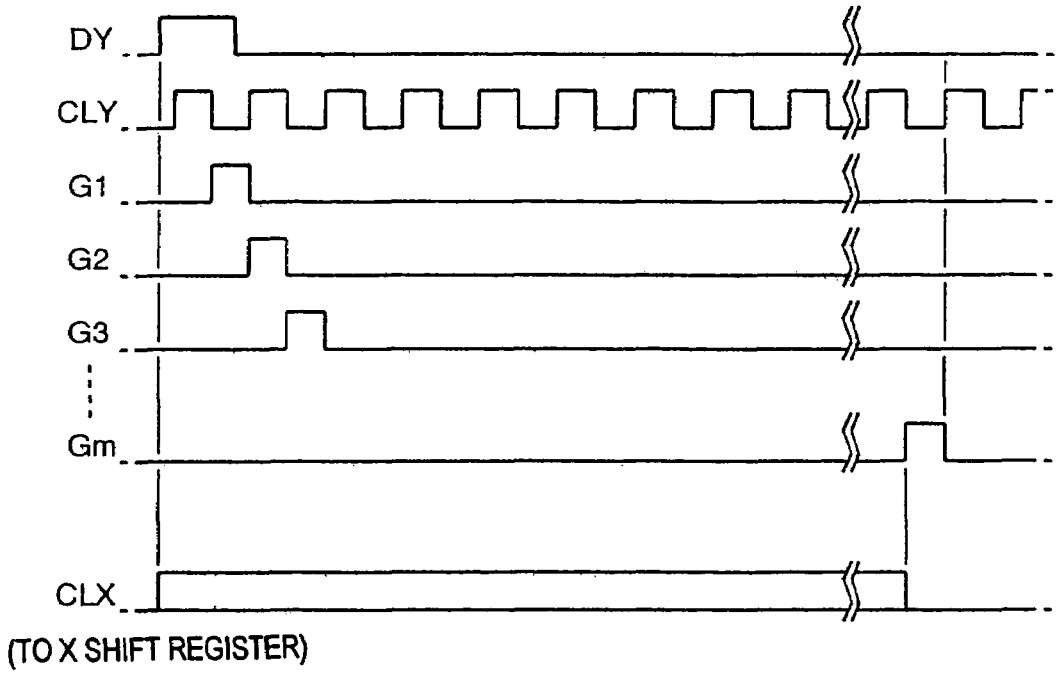
FIG. 13 is a timing chart showing the operation of the clock-signal supply control circuit.

Concerning the clock-signal supply control circuit 400, when the start pulse DY is supplied at the beginning of a particular sub-field, the RS flip-flop 402 is set, and the signal output from the output terminal Q becomes the H level. As a result, the AND circuit 404 opens. As shown in FIG. 13, the supply of the clock signal CLX to the X shift register 1410 (1420) starts. Concerning the data-line driving circuit 140, in response to the latch pulse LP which is supplied thereto immediately thereafter, dot-sequential latching of the two-level signals is performed by the first latch circuit 1420 (1422).

After the supply of the clock signal CLX is started by the start pulse DY, when the scanning signal Gm for selecting the last (m-th from the top) scanning line 112 in the sub-field is supplied, the RS flip-flop 402 is reset. The signal output from the output terminal Q of the RS flip flop 402 becomes the L level. Hence, the AND circuit 404 is closed. As shown in FIG. 13, the supply of the clock signal CLX to the X shift register 1410 (1412) is interrupted. Since the two-level signals for a row of pixels which correspond to the intersections with the m-th scanning line 112 are latched prior to the supply of the scanning signal Gm, no problem is caused if the clock signal CLX is interrupted until the beginning of the subsequent sub-field. In FIG. 13, since the frequency of the clock signal CLX is much higher than the frequency of the clock signal CLY, only the envelope of the clock signal CLX is shown.

With provision of the clock-signal supply control circuit 400, the clock signal CLX is supplied to the X-shift register 1410 (1420) only when necessary. It is possible to suppress the power consumption caused by the capacitive load. Alternatively, a similar clock-signal supply control circuit can be provided for the clock signal CLY at the Y-side. The frequency of the clock signal CLY is much lower than that of the clock signal CLX at the X-side, and hence no serious problem is caused by the power consumption caused by the capacitive load at the Y-side compared with the X-side.

<Application (3)>

In the above-described embodiment and in the applications (1) and (2), the AC drive signal LCOM which is a two-level signal is applied to the counter electrode 108. This is done to prevent DC components from being applied to the liquid crystal 105. In contrast, in an application (3), the potential of the counter electrode 108 is fixed at a reference potential Vref which is determined in advance, and the liquid crystal 105 is AC-driven.

An electro-optical device in the application (3) has the same structure as the electro-optical device of the above-described embodiment except for the fact that the AC drive signal LCOM generated by the timing-signal generating circuit 200 is fixed at the reference potential Vref, that the two-level signal Ds, which is an output signal of the data converter circuit 300, always outputs a logical level shown in a truth table (when FR=L) of FIG. 7(*a*) (that is, when FR=H, the two-level signal Ds shown in FIG. 7(*a*) is output), and that a three-level signal generating circuit 1440 for generating a three-level signal is included in the data-line driving circuit 140.

Figure 14:
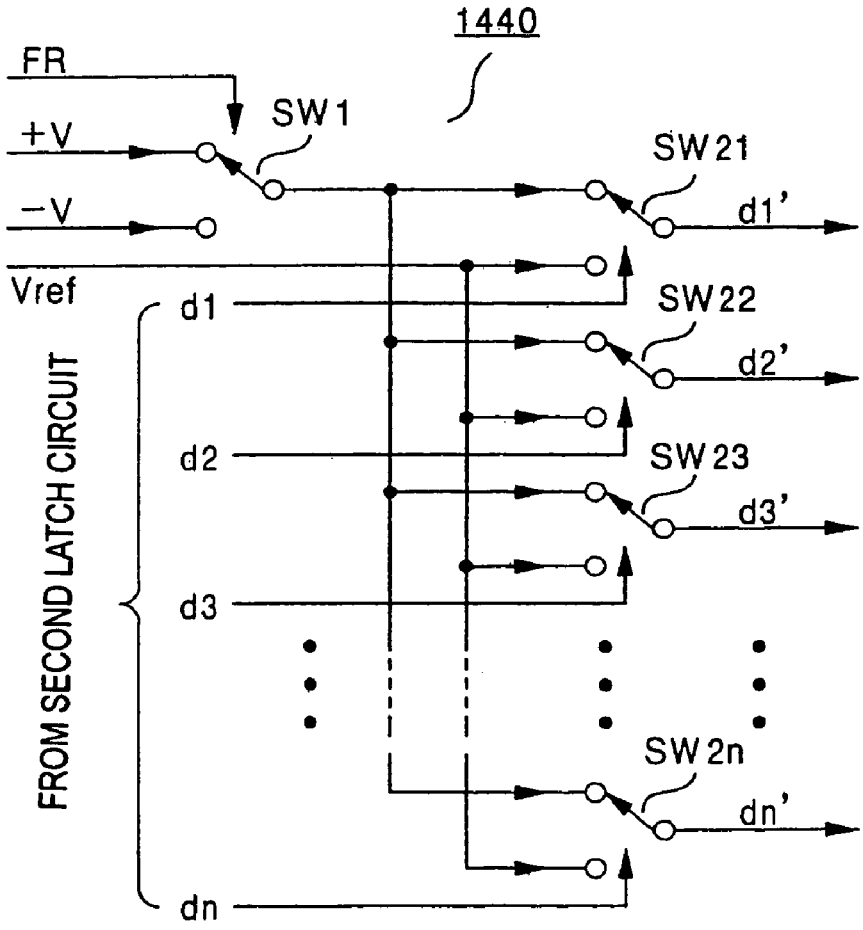
FIG. 14 is a circuit diagram of a three-level signal generating circuit according to an application of the electro-optical device.

FIG. 14 is a circuit diagram of the three-level signal generating circuit 1440. The three-level signal generating circuit 1440 is provided at the subsequent stage of the second latch circuit 1430 shown in FIG. 6 or FIG. 10. The three-level signal generating circuit 1440 converts the output signals d1, d2, d3, . . . , dn of the second latch circuit 1430, which undergo transitions between the H level and the L level, into three-level signals and outputs the three-level signals as data signals d1', d2', d3', . . . , dn' to the respective data lines 114.

As shown in FIG. 14, the three-level signal generating circuit 1440 consists of switch SW1 and n switches SW21, SW22, SW23, . . . , SW2*n*. From a voltage source (not shown), a reference potential Vref, a positive voltage +V at a positive polarity side, and a negative voltage −V at a negative polarity side, the positive voltage +V and the negative voltage −V being given with the reference potential Vref at the center, are supplied to the three-level signal generating circuit 301. The switch SW1 is controlled by the AC signal FR. If the logical level of the AC signal FR is the H level, the switch SW1 selects the negative voltage −V. If the logical level is the L level, the switch SW1 selects the positive voltage +V.

The signals d1, d2, d3, . . . , dn are supplied to control terminals of the switches SW21, SW22, SW23, . . . , SW2*n*, respectively. When the level of the respective control terminal is the H level, the switches SW21 to SW2*n* each select an output signal of the switch SW1. When the level of the control terminal is the L level, the switches SW21 to SW2*n* each select the reference potential Vref. Accordingly, the three-level data signals d1', d2', d3', . . . , dn' can be produced digitally without using an analog circuit such as an amplifier.

With the above arrangement, when the AC signal FR is at the H level, the negative voltage −V is supplied to one input terminal of each of the switches SW21 to SW2*n*. In this case, when the output signals d1 to dn of the second latch circuit 1430 are at the H level, the switches SW21 to SW2*n* select the negative voltage −V. When the output signals d1 to dn are at the L level, the switches SW21 to SW2*n* select the reference potential Vref. Thus, when the output signals d1 to dn are at the H level, the data signals d1' to dn' become active, and pixels are to be turned on during the time period.

In contrast, when the AC signal FR is at the L level, the positive voltage +V is supplied to one input terminal of each of the switches SW21 to SW2*n*. In this case, when the output signals d1 to dn of the second latch circuit 1430 are at the H level, the switches SW21 to SW2*n* select the positive voltage +V. If the output signals d1 to dn are at the L level, the switches SW21 to SW2*n* select the reference potential Vref. Thus, when the output signals d1 to dn are at the H level, the data signals d1' to dn' become active, and pixels are to be turned on during the time period.

Figure 15:
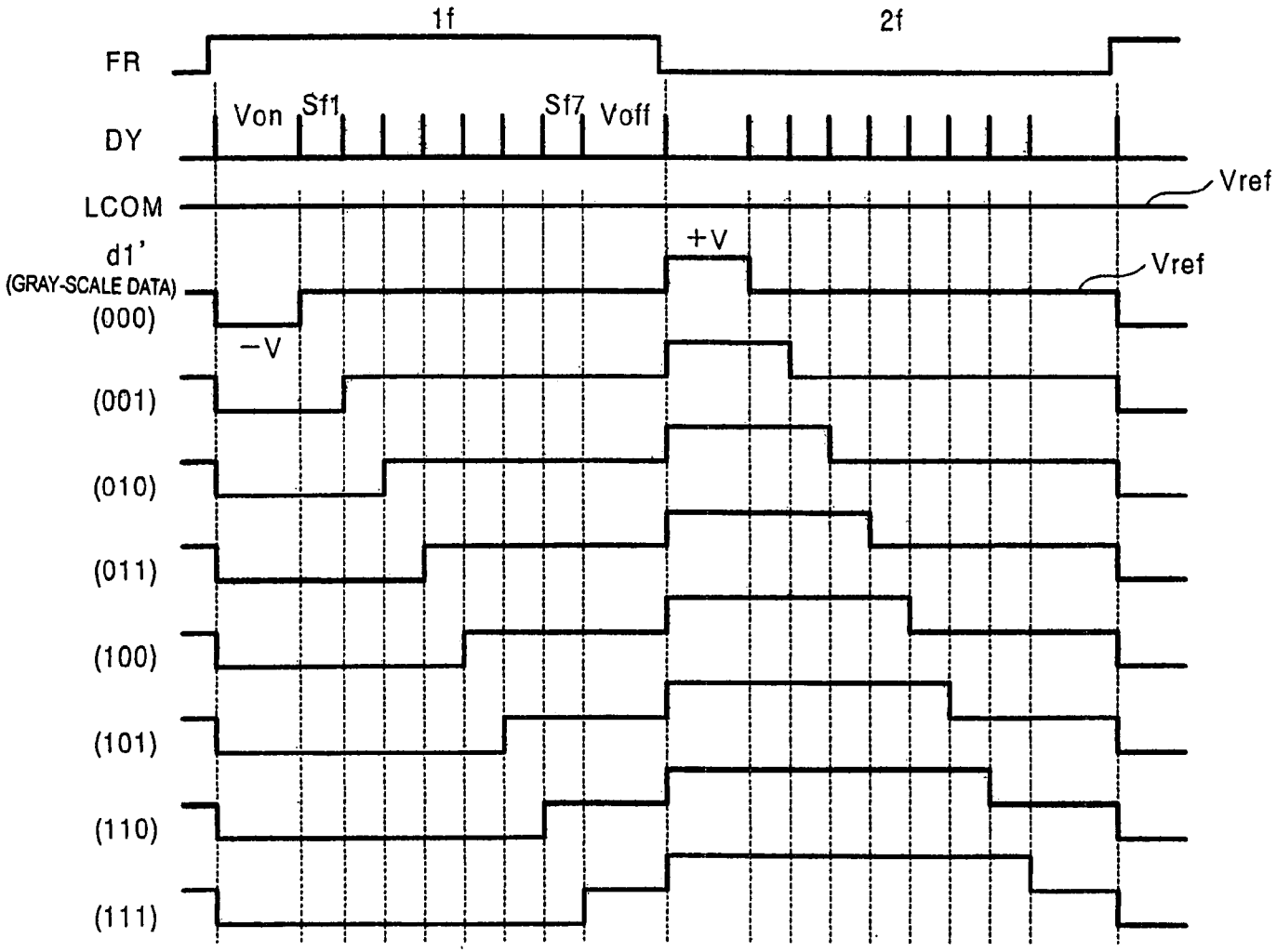
FIG. 15 is a timing chart showing a voltage applied to the opposing substrate and a voltage applied to the pixel electrodes in the electro-optical device in time frame units.

FIG. 15 is a timing chart showing gray-scale data and waveforms of signals applied to the pixel electrode 118 in the electro-optical device of the application (3). FIG. 15 corresponds to FIG. 9. As shown in the drawing, the waveform of a signal (in this example, the data signal d1') applied to the pixel electrode 118 swings to the negative polarity side, with the reference potential Vref at the center, in a first time frame 1*f*, whereas the waveform swings toward the positive polarity side in a second time frame 2*f*. It is adjusted that the absolute value of a voltage at the negative polarity side and the absolute value of a voltage at the positive polarity side are of the same value V. In view of the combination of the first time frame If and the second time frame 2*f*, a DC voltage is not applied to the liquid crystal 108.

The duration of the Von period is obtained in accordance with the threshold value of the transmissivity characteristics. Thus, even when the waveform of the signal applied to the pixel electrode 118 is inverted periodically, the voltage in accordance with the threshold value of the transmissivity characteristics is effectively applied. Since the time periods for applying the positive voltage +V and the negative voltage −V relative to the reference potential Vref are adjusted in accordance with the gray-scale data, the voltage in accordance with the gray-scale data is effectively applied to the liquid crystal 105. In other words, although the applied waveform has three levels, a two-level signal which turns on or off a pixel is applied to the liquid crystal 105, if the voltage applied to the liquid crystal 105 is regarded effectively. In this regard, the electro-optical device of the application (3) is similar to the electro-optical device of the above-described embodiment.

According to the electro-optical device of the application (3), as in the above-described embodiment, the signal which turns on or off each pixel has two levels. Hence, it is not necessary to have a circuit such as a high-accuracy D/A converter or an operational amplifier for processing analog signals in a peripheral circuit such as a driving circuit. In addition, apart from the sub-fields, the Von period and the Voff period are allocated within one time frame, and the duration of the Von period is adjusted by the voltage Va at which the transmissivity characteristic of the liquid crystal starts rising. Accordingly, the application (3) can be applied to electro-optical devices using various types of liquid crystal, thereby increasing the versatility of the device.

A voltage applied to each pixel may be shifted by characteristics of the transistor 116, the storage capacity 119, and the capacitance of the liquid crystal 105. In such a case, it is preferable that the reference potential Vref, which is to be applied to the counter electrode 110 as the AC drive signal LCOM, be shifted from the central voltage (voltage when d1 to dn are at the L level) in accordance with the shifted amount.

<Overall Structure of Liquid Crystal Display>

Figure 16:
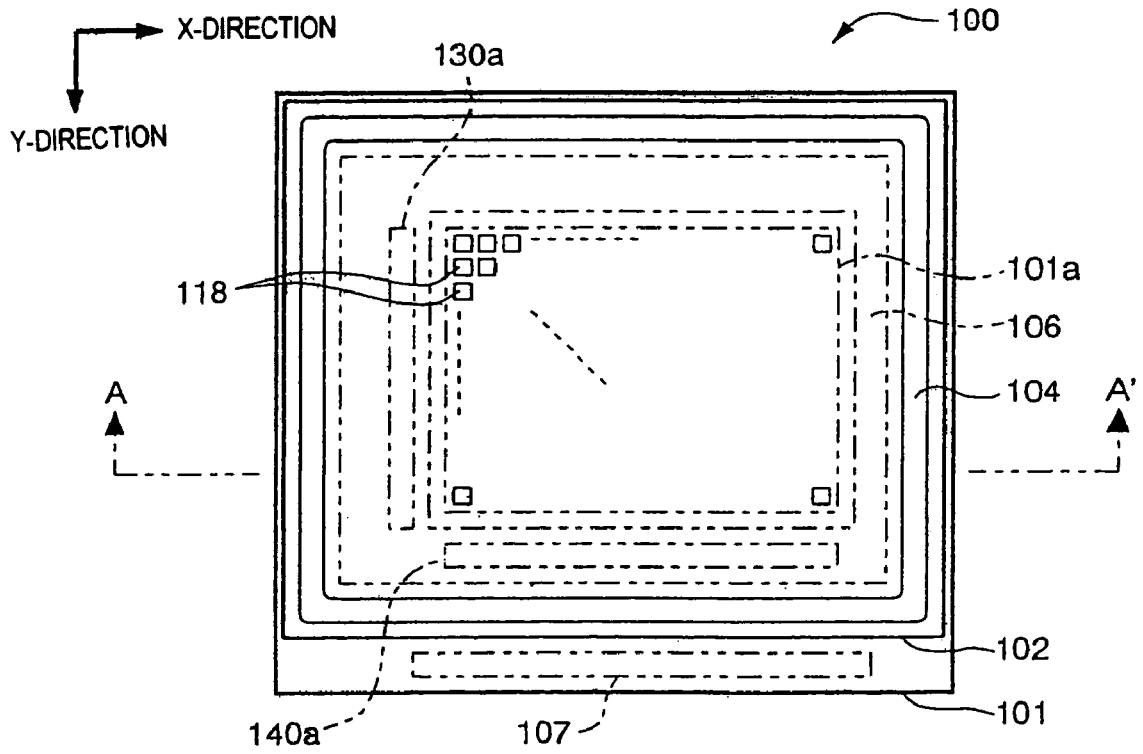
FIG. 16 is a plan view of the structure of the electro-optical device.
Figure 17:
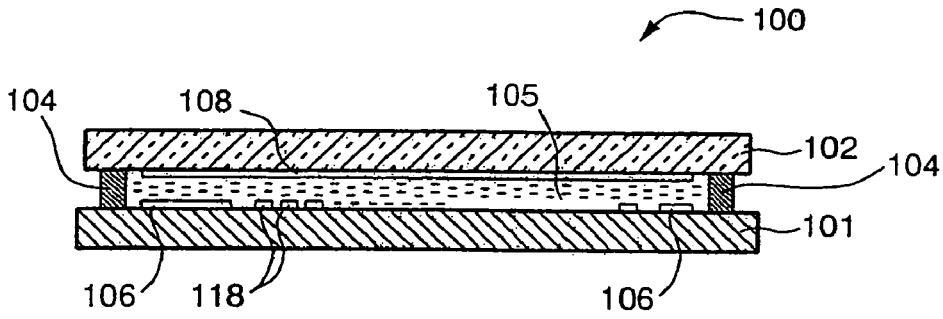
FIG. 17 is a sectional view of the structure of the electro-optical device.

The structure of the electro-optical device according to the above-described embodiment and the applications will now be described with reference to FIGS. 16 and 17. FIG. 16 is a plan view of the structure of an electro-optical device 100. FIG. 17 is a sectional view taken along the line A–A' of FIG. 16.

As shown in the drawings, the structure of the electro-optical device 100 includes an element substrate 101 on which the pixel electrodes 118 are formed X1 and an opposing substrate 102 on which the counter electrode 108 is formed. The element substrate 101 and the opposing substrate 102 are bonded with a predetermined separation by a sealing section 104, and the separation is filled with the liquid crystal 105 as the electro-optical material. In fact, the sealing section 104 has a notch. The liquid crystal 105 is injected through the notch, and subsequently the sealing section 104 is sealed by a sealant (not shown in the drawings).

As described above, since the element substrate 101 is a semiconductor substrate, the element substrate 101 is opaque. For this reason, the pixel electrodes 118 are formed of reflective metal such as aluminum. As a result, the electro-optical device 100 is used as a reflection-type device. In contrast, the opposing substrate 102 is formed of glass or the like, and hence the opposing substrate 102 is transparent.

A light-blocking film 106 is provided in a region inside the sealing section 104 and outside the display region 101*a*. In the region in which the light-blocking film 106 is formed, the scanning-line driving circuit 130 is formed in a region 130*a*, and the data-line driving circuit 140 is formed in a region 140*a*. In other words, the light-blocking film 106 prevents light from entering into the driving circuits formed in these regions. Together with the counter electrode 108, the AC drive signal LCOM is applied to the light-blocking film 106. In the region in which the light-blocking film 106 is formed, a voltage applied to the liquid crystal layer is substantially zero. Hence, the device is in the same display state as a no-voltage-applied state of the pixel electrodes 118.

On the element substrate 101, a plurality of connection terminals is formed in a region 107 outside the region 140*a* in which the data-line driving circuit 140 is formed, with a separation from the sealing section 104. Control signals and power are input to the region 107 from the outside.

Concerning the counter electrode 108 on the opposing substrate 102, electrical conduction is established with the light-blocking film 106 and the connection terminals on the element substrate 101 by conductive material (not shown) which is provided in at least one corner of the four corners at which the counter electrode 108 is bonded to the substrate 102. In other words, the AC drive signal LCOM is applied through the connection terminals provided on the element substrate 101 to the light-blocking film 106, and supplied to the counter electrode 108 through the conductive material.

In accordance with the usage of the electro-optical device 100, for example, when the electro-optical device 100 is a direct-viewing-type device, first, color filters which are aligned in stripes or in the form of a mosaic or a triangle are provided on the opposing substrate 102. Second, for example, a light-blocking film (black matrix) made of metal material or resin is formed on the opposing substrate 102. For example, when the usage is to modulate colored light rays, that is, when the electro-optical device 100 is used as a light valve of a projector which will be described below, color filters are not formed. When the electro-optical device 100 is a direct-viewing-type device, a front light unit for irradiating the electro-optical device 100 with light from the opposing substrate 102 side is provided if necessary. On electrode-forming surfaces of the element substrate 101 and the opposing substrate 102, alignment layers (not shown) which are rubbed in predetermined directions are formed, respectively, defining alignment directions of liquid crystal molecules in a no-voltage-applied state. At the opposing substrate 101 side, a polarizer (not shown) in accordance with the alignment direction is formed. If macromolecular dispersed liquid crystal in which the liquid crystal is dispersed as microparticles in a macromolecule is used as the liquid crystal 105, the above alignment layers and the polarizer become unnecessary. As a result, the efficiency in light utilization is increased. It is therefore advantageous in increasing luminance and reducing power consumption.

<Application (4)>

In the above-described embodiment, both the Von period and the Voff period are provided within one time frame. Alternatively, only the Von period can be provided. An embodiment of this is described below. Descriptions of the common portions with the above-described embodiment are omitted. The present embodiment has the same structure as that in the above-described embodiment except for the fact that only the Von period is provided.

For example, when the gray-scale data is 000, the two-level signals Ds which turn off a pixel are output in all the sub-fields. When the gray-scale data is 001, the two-level signal Ds at a level at which a pixel is turned on is output in the sub-field Von. Concerning the gray-scale data above these data, every time the value of the gray-scale data increases by 1, the number of the sub-fields in which the two-level signal Ds for turning on a pixel is output increases by 1.

In the sub-field Von, when the gray-scale data is 001 or greater, the two-level signal Ds which turns on a pixel regardless of the gray-scale data, is output. This two-level signal Ds is output from the data converter circuit 300 to the data-line driving circuit 140 in order to apply an effective voltage of about the threshold value Va shown in FIG. 1(*a*) to the pixel. The duration of the sub-field Von is determined in order that, when application of the predetermined voltage VH is maintained for the period of the sub-field Von, an effective voltage of about the threshold value Va is applied to the pixel. Although the sub-fields other than the sub-field Von can be of nonuniform duration in order to compensate for non-linear voltage/transmissivity characteristics of the liquid crystal, the sub-fields Sf1 to Sf7 except for the sub-field Von are of the equal duration in the present embodiment in order to simplify the circuit configuration of a control system.

Figure 18:
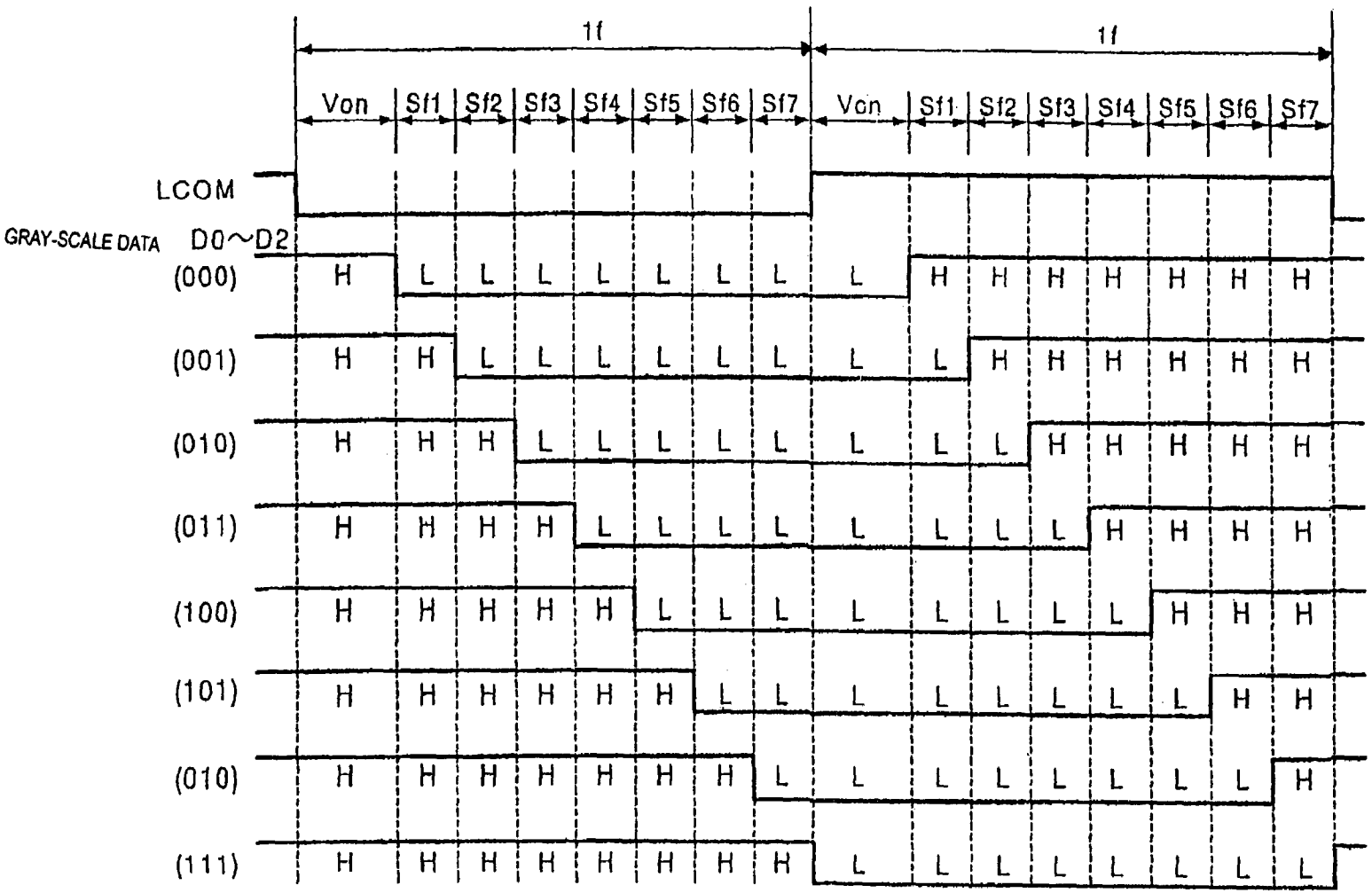
FIG. 18 is a timing chart showing the operation of an application.

In the application (4), when the gray-scale data is 000, a voltage which turns off the pixel is applied for the period of the sub-field Von. However, it is also possible to apply a voltage which turns on the pixel for the period of the sub-field Von as in the other gray levels. This is because there is no difference in the transmissivity between the two cases since the effective voltage applied to the liquid crystal for the period of Von is Va. In FIG. 18, a timing chart illustrating a case in which a voltage which turns on the pixel is applied for the period of Von.

When the gray-scale data is 000, and when a voltage which turns off the pixel is applied for the period of Von, it is possible to reduce power consumption and enhance contrast. When applying a voltage which turns on the pixel, the circuit configuration is simplified.

The present embodiment is, of the embodiment which is illustrated in the first place.

<Others>

In the embodiments, the element substrate 101 forming the electro-optical device is a semiconductor substrate, and the transistors 116 connected to the pixel electrodes 118 and components of the driving circuits are formed of MOSFETs. However, the present invention is not limited to these embodiments. For example, the element substrate 101 can be an amorphous substrate made of glass or quartz. A semiconductor thin film can be deposited on the element substrate 101, and hence a TFT can be formed. When the using TFT in this manner, a transparent substrate can be used as the element substrate 101.

Apart from the liquid crystal, an electroluminescence device or the like can be used as the electro-optical material. The present invention can be applied to devices which perform display using electro-optical effects.

In the case of organic EL devices, AC driving such as the liquid crystal and polarity inversion are unnecessary.

In other words, the present invention is applicable to electro-optical devices which are constructed similarly to the above-described structure, and particularly to all electro-optical devices which perform gray-scale display using pixels performing two-level (on or off) display.

<Electronic Apparatus>

A few examples of using the above-descried liquid crystal display in specific electronic apparatuses will now be described.

<1: Projector>

Figure 19:
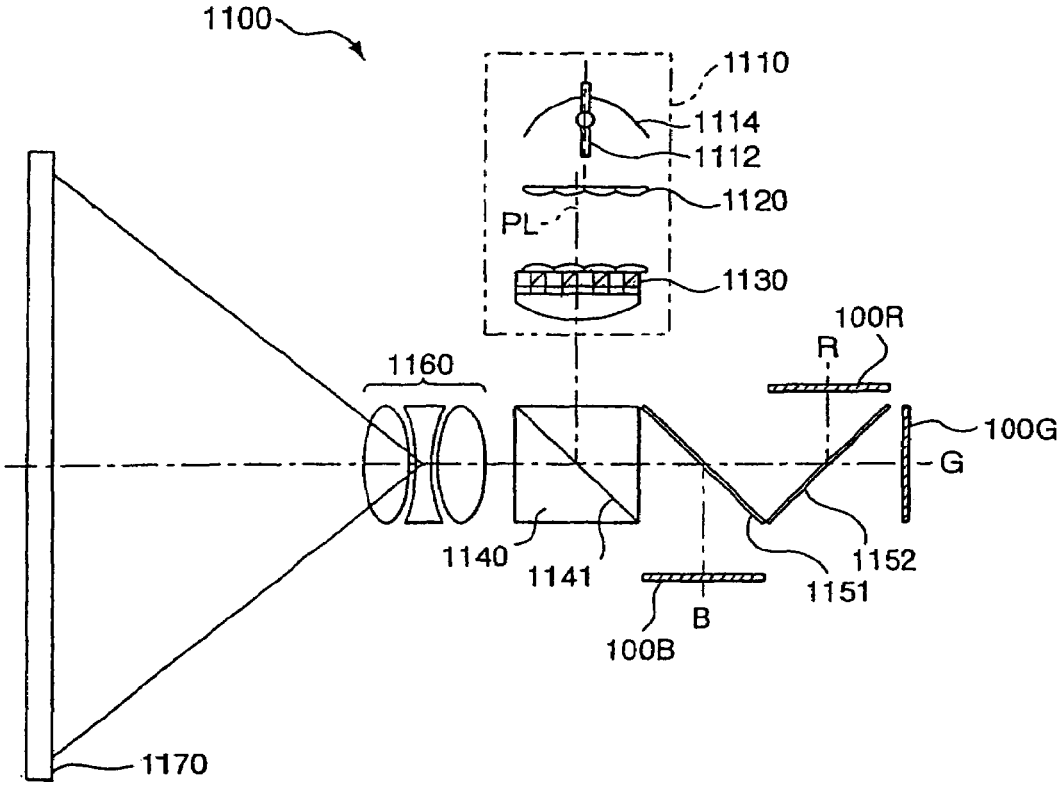
FIG. 19 is a sectional view of the structure of a projector as an example of an electronic apparatus to which the electro-optical device is applied.

A projector which uses the electro-optical device according to the embodiments is described. FIG. 19 is a plan view of the structure of the projector. As shown in the drawing, a polarizing illumination device 1110 is disposed along a system optical axis PL in a projector 1100. Concerning the polarizing illumination device 1110, light emitted from a lamp 1112 enters a first integrator lens 1120 as luminous fluxes which are substantially parallel to one another by reflection from a reflector 1114. In this manner, the light emitted from the lamp 1112 is divided into a plurality of intermediate luminous fluxes. The intermediate luminous fluxes are converted into polarized luminous fluxes of a single type (s-polarized luminous fluxes) in which polarization directions are substantially aligned by a polarization conversion element 1130 which includes a second integrator lens at the light-incident side. The s-polarized luminous fluxes are emitted from the polarizing illumination device 1110.

The s-polarized luminous fluxes are reflected by an s-polarized luminous flux reflector 1141 of a polarization beam splitter 1140. Of the reflected luminous fluxes, the blue light flux (B) is reflected by a blue-light reflecting layer of a dichroic mirror 1151, and the reflected light is modulated by a reflection-type electro-optical device 100B. Of the luminous fluxes which pass the blue-light reflecting layer of the dichroic mirror 1151, the red light flux (R) is reflected by a red-light reflecting layer of a dichroic mirror 1152, and the reflected light is modulated by a reflection-type liquid electro-optical device 100R. At the same time, of the luminous fluxes which pass the blue-light reflecting layer of the dichroic mirror 1151, the green light flux (G) passes through the red-light reflecting layer of the dichroic mirror 1152 and is modulated by a reflection-type electro-optical device 100G.

In this manner, red light, green light, and blue light which are modulated by the electro-optical devices 100R, 100G, and 100B are sequentially combined by the polarization beam splitter 1140, and the combined light is projected onto a screen 1170 by a projecting optical system 1160. Since the luminous fluxes corresponding to primary colors R, G, and B enter the electro-optical devices 100R, 100B, and 100G through the dichroic mirrors 1151 and 1152, color filters are unnecessary.

<2: Mobile Computer>

Figure 20:
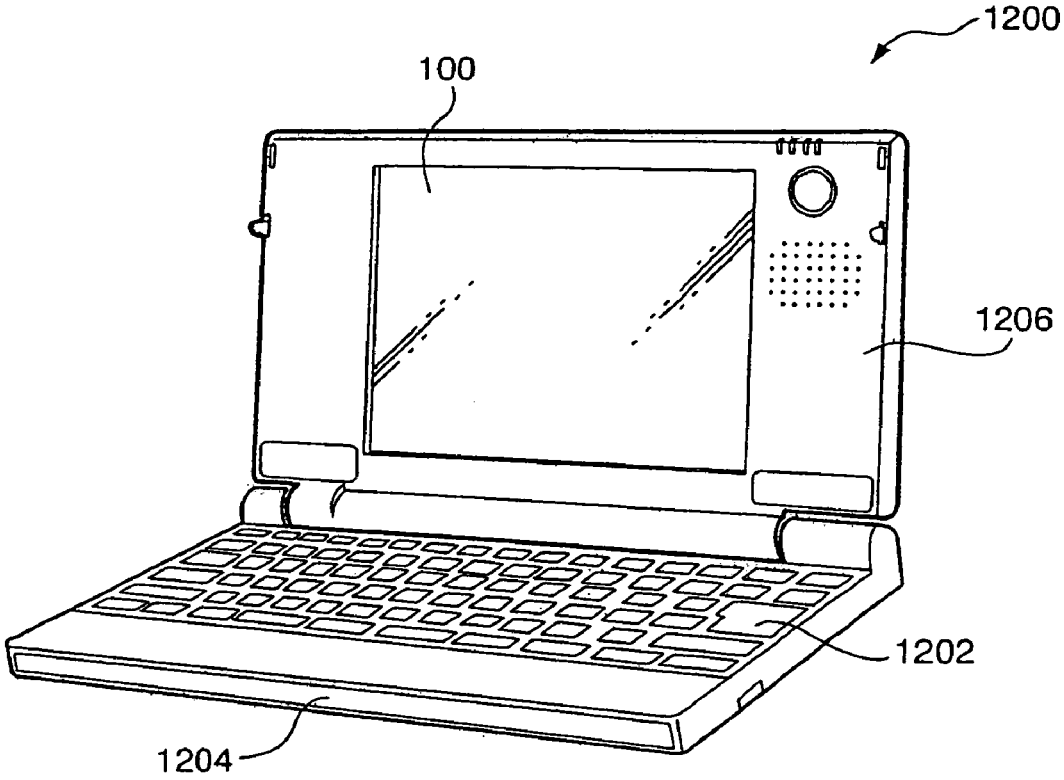
FIG. 20 is a perspective view of the structure of a personal computer as an example of an electronic apparatus to which the electro-optical device is applied.

An example in which the above-described electro-optical device is applied to a mobile personal computer will now be described. FIG. 20 is a perspective view of the structure of the personal computer. In the drawing, a computer 1200 includes a main unit 1204 including a keyboard 1202 and a display unit 1206. The display unit 1206 includes a front light unit in front of the above-described electro-optical device 100.

With this arrangement, the electro-optical device 100 is used as a reflecting direct-viewing-type device. Concerning the pixel electrodes 118, it is preferable that concavity and convexity be formed so that the reflected light scatters in various directions.

<3: Cellular Phone>

Figure 21:
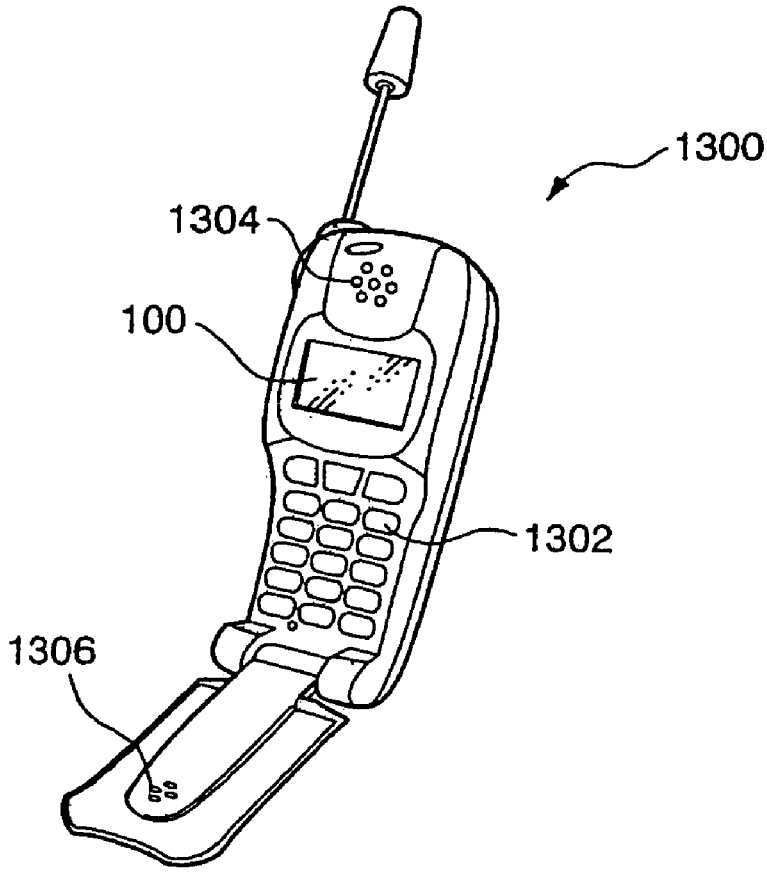
FIG. 21 is a perspective view of the structure of a cellular phone as an example of an electronic apparatus to which the electro-optical device is applied.

An example in which the above-described electro-optical device is applied to a cellular phone will now be described. FIG. 21 is a perspective view of the structure of the cellular phone. In the drawing, a cellular phone 1300 includes a plurality of operation buttons 1302, an earpiece 1304, a mouthpiece 1306, and the electro-optical device 100. If necessary, a front light unit is provided in front of the electro-optical device 100. With this arrangement, the electro-optical device 100 is used as a reflecting direct-viewing-type device. Concerning the pixel electrodes 118, it is preferable that concavity and convexity be formed.

Concerning the electronic apparatuses, examples other than those described with reference to FIGS. 19 to 21 may be given. These examples include a liquid crystal television, a viewfinder-type or a monitor-direct-viewing-type video cassette recorder, a car navigation system, a pager, an electronic notebook, an electronic calculator, a word processor, a workstation, a video phone, a POS terminal, and a device with a touch panel. Needless to say, the electro-optical device according to the embodiments and the applications is applicable to these various types of electronic apparatuses.

As described above, according to the present invention, a signal applied to data lines has two levels, and hence high-quality gray-scale display can be performed. In addition, the present invention can be applied to various types of electronic apparatuses using a simple structure.

What is claimed is:

1. A driving method for an electro-optical device which performs gray-scale display of a plurality of pixels arranged in a matrix, the driving method comprising:

dividing a first time period which is part of a single time frame into a plurality of sub-fields, and in each sub-field, turning on or off each pixel by applying to the pixel one of two-level signals for a period of the sub-field, the cumulation of on periods during the first time period of the single time frame being variably controlled in accordance with a gray-scale level of the pixel for the gray-scale display; and applying an effective voltage to the pixels in a second time period, the second time period being dispersed in the period of the single time frame, in accordance with a threshold voltage of a transmissivity characteristic relative to a voltage applied to electro-optical material used in the electro-optical device, turning on and off periods in the second time period being separated in a time period of one frame and the first time period being inserted between the turning on and off periods.

2. The driving method for an electro-optical device according to claim 1, wherein the pixels are only turned on for a period in accordance with the threshold voltage of the transmissivity characteristic within the second time period.

3. The driving method for an electro-optical device according to claim 1, further comprising:

providing the pixels corresponding to respective intersections of a plurality of scanning lines and a plurality of data lines;

supplying scanning signals to the respective scanning lines, when the pixels are turned on/off in accordance with voltages applied to the data lines;

supplying sequentially in the first time period, the scanning signals to the respective scanning lines during every sub-field;

designating turning on or off of each pixel in accordance with a gray-scale level of the pixel when signals are supplied to the respective data lines which correspond to the respective pixels;

supplying sequentially in the second time period, the scanning signals to the respective scanning lines; and designating turning on or off of the pixels in accordance with the threshold value of the transmissivity characteristic relative to the voltage applied to the electro-optical material supplied to the data lines.

4. The driving method for an electro-optical device according to claim 3, wherein the second time period includes an on period for turning on all the pixels and an off period for turning off all the pixels, and the length of the on period is determined in accordance with the threshold value of the transmissivity characteristic relative to the voltage applied to the electro-optical material.

5. The driving method for an electro-optical device according to claim 4, further comprising:

detecting a temperature, of the electro-optical device; and determining the length of the on period in the second time period in accordance with the detected temperature.

6. The driving method for an electro-optical device according to claim 1, further comprising displaying the lowest gray-scale level by the pixels being turned off in the second time period.

7. The driving method for an electro-optical device according to claim 1, further comprising the pixels being turned on in the second time period independent of gray-scale data.

8. A driving method for an electro-optical device which performs gray-scale display of a plurality of pixels arranged in the form of a matrix, the driving method comprising:

dividing a first time period which is part of a single time frame into a plurality of sub-fields, and in each sub-field, turning on or off each pixel by applying to the pixel one of two-level signals for a period of the sub-field, the cumulation of on periods during the first time period of the single time frame being variably controlled in accordance with a gray-scale level of the pixel for the gray-scale display; and turning on the pixels in a second time period, the second time period being dispersed in the period of the single time frame, in accordance with a threshold voltage of a transmissivity characteristic relative to a voltage applied to electro-optical material used in the electro-optical device, turning on and off periods in the second time period being separated in a time period of one frame and the first time period being inserted between the turning on and off periods.

9. The driving method for an electro-optical device according to claim 8, further comprising:

providing the pixels corresponding to respective intersections of a plurality of scanning lines and a plurality of data lines;

supplying scanning signals to the respective scanning lines, when the pixels are turned on/off in accordance with voltages applied to the data lines;

supplying sequentially in the first time period, the scanning signals to the respective scanning lines during every sub-field;

designating turning on or off of each pixel in accordance with a gray-scale level of the pixel when signals are supplied to the respective data lines which correspond to the respective pixels;

supplying sequentially in the second time period, the scanning signals to the respective scanning lines; and designating turning on of the pixels for a period in accordance with the threshold value of the transmissivity characteristic relative to the voltage applied to the electro-optical material supplied to the data lines.

10. The driving method for an electro-optical apparatus device according to claim 9, further comprising:

detecting a temperature of the electro-optical device; and determining the length of the second time period in accordance with the detected temperature.

11. A driving circuit for an electro-optical device, which drives pixels including pixel electrodes provided corresponding to respective intersections of a plurality of scanning lines and a plurality of data lines and switching devices for establishing conduction between the data lines and the pixel electrodes when scanning signals are supplied to the scanning lines, the driving circuit comprising:

a scanning-line driving circuit for sequentially supplying, in a first time period forming part of a single time frame, the scanning signals to the respective scanning lines for every sub-field obtained by dividing the first time period into sub-fields, and for sequentially supplying the scanning signals, which make the switching devices conducting, to the respective scanning lines in a second time period of the single time frame, excluding the first time period, the second time period being dispersed in the period of the single frame; and a data-line driving circuit for supplying, in the first time period, a sequence of two-level signals, each two-level signal designating turning on or off a respective pixel for a period of a sub-field, to the data lines which correspond to the pixels in a period for supplying the scanning signals to the scanning lines which correspond to the pixels, the cumulation of on periods during the first time period of the single time frame being variably controlled in accordance with a gray-scale level of the respective pixel for a gray-scale display, and for supplying, in the second time period, a signal which designates applying an effective voltage to the pixels in accordance with a threshold value of a transmissivity characteristic relative to a voltage applied to electro-optical material used in the electro-optical device to the data lines which correspond to the pixels, turning on and off periods in the second time period being separated in a time period of one frame and the first time period being inserted between the turning on and off periods.

12. The driving circuit for an electro-optical device according to claim 11, wherein only a signal which designates turning on the pixels is supplied in the second time period.

13. A driving circuit for an electro-optical device, which drives pixels including pixel electrodes corresponding to intersections of a plurality of scanning lines and a plurality of data lines, and switching devices for establishing conduction between the data lines and the pixel electrodes, when scanning signals are supplied to the scanning lines, the driving circuit comprising:

a scanning-line driving circuit for sequentially supplying, in a first time period forming part of a single time frame, the scanning signals to the respective scanning lines for every sub-field which is obtained by dividing the first time period into sub-fields, and for sequentially supplying the scanning signals, which make the switching devices conducting, to the respective scanning lines in a second time period of the single time frame, excluding the first time period, the second time period being dispersed in the period of the single time frame; and a data-line driving circuit for supplying, in the first period, a sequence of two-level signals, each two-level signal designating turning on or off of a respective pixel for a period of a sub-field, to the data lines which correspond to the pixels in a period for supplying the scanning signals to the scanning lines which correspond to the pixels, the cumulation of on periods during the first time period of the single time frame being variably controlled in accordance with a gray-scale level of the respective pixel for a gray-scale display, and for supplying, in the second time period, a signal which designates turning on of the pixels in accordance with a threshold value of a transmissivity characteristic relative to a voltage applied to electro-optical material used in the electro-optical device to the data lines which correspond to the pixels, turning on and off periods in the second time period being separated in a time period of one frame and the first time period being inserted between the turning on and off periods.

14. An electro-optical device, comprising:

an element substrate comprising pixel electrodes corresponding to respective intersections of a plurality of scanning lines and a plurality of data lines and switching devices, being provided for the respective pixel electrodes, to control conduction between the data lines and the pixel electrodes based on scanning signals supplied through the scanning lines;

an opposing substrate comprising a counter electrode being opposed to the pixel electrodes;

electro-optical material held between the element substrate and the opposing substrate;

a scanning-line driving circuit for sequentially supplying, in a first time period forming part of a single time frame, the scanning signals to the respective scanning lines for every sub-field which is obtained by dividing the first time period into sub-fields, and for sequentially supplying the scanning signals, which make the switching devices conducting, to the respective scanning lines in a second time period of the single time frame, excluding the first time period, the second time period being dispersed in the period of the single time frame; and a data-line driving circuit for supplying, in the first time period, a sequence of two-level signals, each two-level signal designating turning on or off a respective pixel for a period of a sub-field, to the data lines which correspond to the pixels in a period for supplying the scanning signals to the scanning lines which correspond to the pixels, the cumulation of on periods during the first time period of the single time frame being variably controlled in accordance with a gray-scale level of the respective pixel for a gray-scale display, and for supplying, in the second time period, a signal which designates turning on or off the pixels in accordance with a threshold value of a transmissivity characteristic relative to a voltage applied to electro-optical material used in the electro-optical device to the data lines which correspond to the pixels, turning on and off periods in the second time period being separated in a time period of one frame and the first time period being inserted between the turning on and off periods.

15. The electro-optical device according to claim 14, wherein only a signal which designates turning on the pixels is supplied in the second time period.

16. The electro-optical device according to claim 14, further comprising:

a two-level signal being supplied to the counter electrode; and the polarity of each signal which designates turning on or off the pixel being inverted in accordance with the level of the two-level signal.

17. The electro-optical device according to claim 14, further comprising:

a potential of the counter electrode being fixed at a predetermined reference potential; and the polarity of each signal which designates turning on or off the pixel being inverted with a predetermined period.

18. The electro-optical device according to claim 17, wherein the signal which designates turning on or off the pixel a three-level signal in which the polarity being inverted with the reference potential at the center.

19. The electro-optical device according to claim 14, wherein the element substrate is formed of a semiconductor substrate, the scanning-line driving circuit and the data-line driving circuit are formed on the element substrate, and the pixel electrodes are reflective.

20. An electronic apparatus comprising an electro-optical device according to claim 14.

21. An electro-optical device, comprising:

an element substrate comprising pixel electrodes corresponding to respective intersections of a plurality of scanning lines and a plurality of data lines and switching devices, being provided for the respective pixel electrodes, to control conduction between the data lines and the pixel electrodes based on scanning signals supplied through the scanning lines;

an opposing substrate comprising a counter electrode being opposed to the pixel electrodes;

electro-optical material held between the element substrate and the opposing substrate;

a scanning-line driving circuit for sequentially supplying, in a first time period forming part of a single time frame, the scanning signals to the respective scanning lines for every sub-field obtained by dividing the first time period into sub-fields, and for sequentially supplying the scanning signals, which make the switching devices conducting, to the respective scanning lines in a second time period of the single time frame, excluding the first time period, the second time period being dispersed in the period of the single time frame; and a data-line driving circuit for supplying, in the first time period, a sequence of two-level signals, each two-level signal designating turning on or off a respective pixel for a period of a sub-field, to the data lines which correspond to the pixels in a period for supplying the scanning signals to the scanning lines which correspond to the pixels, the cumulation of on periods during the first time period of the single time frame being variably controlled in accordance with a gray-scale level of the respective pixel for a gray-scale display, and for supplying, in the second time period, a signal which turns on the pixels in accordance with a threshold value of a transmissivity characteristic relative to a voltage applied to the electro-optical material used in the electro-optical device to the data lines which correspond to the pixels, turning on and off periods in the second time period being separated in a time period of one frame and the first time period being inserted between the turning on and off periods.

* * * * *